US006418701B1

(12) United States Patent
Navarro

(10) Patent No.: US 6,418,701 B1
(45) Date of Patent: Jul. 16, 2002

(54) AUTOMATED FILLING MACHINE AND METHOD

(76) Inventor: Ramon Munoz Navarro, 4829 E. Walnut Ave., Orange, CA (US) 92856

( * ) Notice: Subject to any disclaimer, the term of this patent is extended or adjusted under 35 U.S.C. 154(b) by 0 days.

(21) Appl. No.: 09/643,837

(22) Filed: Aug. 21, 2000

Related U.S. Application Data

(60) Provisional application No. 60/186,752, filed on Mar. 3, 2000.

(51) Int. Cl.[7] ..... B65B 61/26; B65B 31/04; B65B 7/28

(52) U.S. Cl. ..... 53/415; 53/432; 53/471; 53/488; 53/510; 53/136.1; 53/282; 53/284.5; 53/306; 53/332; 53/367; 221/223; 414/795.6; 414/798.1

(58) Field of Search ..... 53/510, 282, 284.5, 53/306, 310–312, 359, 361, 320, 321, 332, 290, 348, 360, 75, 415, 136.1, 432, 471, 488, 489, 367; 414/795.6, 797.8, 797.9, 798.1; 221/223

(56) References Cited

U.S. PATENT DOCUMENTS 2,717,730 A * 9/1955 Blann
2,894,361 A * 7/1959 Ullman et al. ..... 53/346 X
3,220,445 A * 11/1965 Taisey
3,503,182 A * 3/1970 Phipps ..... 53/282
3,835,619 A * 9/1974 Reisman ..... 53/312 X
4,293,049 A 10/1981 Launay
4,420,021 A 12/1983 Strand et al.
4,467,845 A 8/1984 Strand et al.
5,024,048 A * 6/1991 Moore ..... 221/223 X
5,067,308 A * 11/1991 Ward ..... 53/282 X
5,105,859 A 4/1992 Bennett et al.
5,438,814 A * 8/1995 Lovett et al. ..... 53/282 X
5,466,894 A 11/1995 Naef
5,617,705 A * 4/1997 Sanfilippo et al. ..... 53/432
5,746,258 A 5/1998 Huck

* cited by examiner

*Primary Examiner*—Stephen F. Gerrity
(74) *Attorney, Agent, or Firm*—Peter J. Georges; William D. Breneman

(57) ABSTRACT

An automatic bulk filling machine is provided having a container input end which includes a fill station for filling a container in accordance with weight or volume requirements followed by a lid dispensing and attachment station wherein the lids of the container are placed over the container in registry with the lip of the container and closed onto the bulk container by a piston cylinder combination having a lid pad for pressing and deforming the center of the lid onto the bulk container before press fitting the bulk container lid onto the bulk container which filled and sealed bulk container is then transferred to an optional labeling station and subsequently transferred to the output end of the conveyor to complete the automated filling, sealing and labeling operations for removal of the container from the automated bulk filling machine. Optional gassing, accumulating, labeling, filling and bulk container separation and advancement devices may be provided to further increase the capacity and production capabilities of the novel automated bulk filling machine.

46 Claims, 22 Drawing Sheets

FIG. 27

| FIG. 27A | FIG. 27C |
|---|---|
| FIG. 27B | |

FIG. 27C

BILL OF MATERIALS

| ITEM | TAG | QTY | DESCRIPTION | CATALOG NO. | MNFR |
|---|---|---|---|---|---|
| 01 | | 6 | LEGEND PLATE (CUSTOM) | 800TX559E | ALLEN BRADLEY |
| 02 | | 1 | LEGEND PLATE-PUSH TO STOP ... | 800TX618 | ALLEN BRADLEY |
| 03 | SW1 | 1 | ILL P.B. 2POS MAINTAINED | 800TFXP16RA1 | ALLEN BRADLEY |
| 04 | SW2 | 1 | SEL SW 3POS MAINTAINED | 800TJ2A | ALLEN BRADLEY |
| 05 | SW3 | 1 | P.B. MOMENTARY,GREEN BOOTED | 800TR1A | ALLEN BRADLEY |
| 06 | SW4-7 | 3 | SELECTOR SW. 2POS MAINTAINED | 800THA2 | ALLEN BRADLEY |
| 07 | F1F2 | 1 | FUSE BLOCK 30a, 600v | 1491N122 | ALLEN BRADLEY |
| 08 | 2MR | 1 | CONTACTOR, 4 POLE | 700P400A1 | ALLEN BRADLEY |
| 09 | | 7 | RELAY BASE OCTAL 8 PIN | 700HN190 | ALLEN BRADLEY |
| 10 | | 1 | RELAY BASE OCTAL 11 PIN | 700HN101 | ALLEN BRADLEY |
| 11 | TR | 3 | TIMER RELAY OCTAL BASE 8 PIN 120V | RTEP11 | IDEC |
| 12 | CR | 4 | RELAY OCTAL 8 PIN, 120VAC | 700HA32A1 | ALLEN BRADLEY |
| 13 | CR | 1 | RELAY OCTAL BASE 11 PIN,120VAC | 700HA33A1 | ALLEN BRADLEY |
| 14 | M1 | 1 | MOTOR 1/6 HP 115/230V 60RPM | 6Z820 | GRAINGER |
| 15 | M2 | 1 | MOTOR 1/2 HP 115/230V 45RPM | E525-SEP | US ELECTRIC |
| 16 | LS1-5 | 4 | LIMIT SWITCH SPRING RETURN,LEVER TP | 802M AYS | ALLEN BRADLEY |
| 17 | P1P2 | 2 | PHOTOELECTRIC SWITCH | 6000 | ALLEN BRADLEY |
| 18 | | 1 | ENCLOSURE NEMA 4x | A-18149-JFG | HOFFMAN |
| 19 | | 1 | BACK PANEL | | HOFFMAN |
| 20 | | | | | |
| 21 | | 4 | AIR CYLINDER | 6D641 | SPEEDAIR |
| 22 | | 2 | AIR CYLINDER | 6D658 | SPEEDAIR |
| 23 | | 2 | AIR CYLINDER | 24-20-1403-130 | ARO |
| 24 | SV1-5 | 1 | AIR CYLINDER | 1M851000-3040 | |
| 25 | SVS | 5 | PNEUMATIC VALVE, 120VAC | A21288120-A-G | ARO |
| 26 | | 1 | LOADCELL UNIT | | GERIF ELECTRIC |
| 27 | | 1 | SCALE DISPLAY | | SCALE SYSTEMS |

L1 110VAC
F2 F1
2
3
L2
SW1 POWER
4
5
POWER
SW2 SCALE
50
SCALE
CONT. AT 1ST STATION
SW3 DE-NEST
11
PHOTO SWITCH 1
P1
12
CR3
INTERVAL, 1.5 SEC 5,6
INDEX HOME POS. LS1
118
CR3
SV1
DE-NEST CYL.
SW4 INDEX CONYR.
58
LS2 HEAD DOWN
6
R3
8
R4
9
SCALE RELAY 2
10
CR1
INDEX MOTOR RELAY 24
TR2
TR2
INTERVAL 1/2 SEC.
LS1 INDEX HOME POS.
SW5 MANUAL ADVANCE
10
SW5 CIP/FILL
14
SCALE RELAY 1
15
PHOTO SWITCH 2
P2
CONTAINER AT FILL STATION
16
LS2
CR4
6,12,13,14
CR4
18
CR4
19
SV3
FILL HEAD
CR4
17
CR5
40
SV2
FILL VALVE
CR5

AUTOMATED FILLING MACHINE AND METHOD

RELATED APPLICATIONS

This application is entitled to priority based on Provisional Application Ser. No. 60/186,752 filed Mar. 3, 2000.

BACKGROUND OF THE INVENTION

1. Field of the Invention

The invention pertains to a novel automated filling machine in which at one end empty containers are introduced to the novel automated filling machine and at the other end a completed filled, sealed and optionally labeled and processed container is presented for packaging and shipment. More particularly the novel automated filling machine is designed to handle bulk containers and includes an input end for receiving empty bulk containers and incrementally advancing the empty bulk containers to a number of work stations including a filling station where the container is automatically filled by weight or by volume with a bulk material, which filled bulk container is then automatically transferred to a lid application work station where lids are automatically advanced to a position over the top of the bulk container and placed in registry with the sealing lip of the bulk container.

A piston having a lid pad at the terminal end in combination with a lid fixation plate is advanced onto the top of the bulk container lid resulting in the lid pad first contacting the center area of the bulk container lid and deforming the bulk container lid at the center of the lid downwardly toward the center of the bulk container prior to the contact of the lid fixation plate to subsequently push the perimeter of the bulk container lid down over the perimeter of the bulk container to lock the bulk container lid onto the bulk container. Means is provided on the perimeter of the lid fixation plate to limit the lateral expansion of the sides of the lid to prevent damages to the sides of the lid and maintain the integrity of any tear strip seal provided at the lower side of the lid.

The lid pad assists in the expelling of excess air or gasses from the interior of the bulk container by the deformation of the bulk container lid prior to the advancement of the lid fixation or lid attachment mechanism to seal the bulk container. The lid attachment mechanism also includes a container positioning mechanism for positioning the container directly under the lid application work station before a lid is placed in registry with the lip of the container. An optional gassing port may be provided to gas the bulk container prior to the application of the bulk container lid in some filling operations. Once the bulk container lid is applied and sealed to the container the filled and sealed container is then automatically advanced from the sealing station to an optional labeling station where the container is labeled with a container label prior to its advancement to an optional accumulation device for accumulating the filled, sealed and labeled containers before removal or advancement of the containers in predetermined groups to a shipment placket.

The novel automated filling machine is designed in the best mode to automatically advance one container from a nested stack of containers and preferably fill at least one container while at least one other container is being sealed and optionally at least one other bulk container is being labeled in a fully automated operation. In a further embodiment of the invention the optional accumulation device is provided to accumulate filled sealed and labeled containers in groups of containers prior to being transferred from the novel automated bulk filling machine. In the preferred embodiment of the invention the operation of filling, sealing and optionally labeling and accumulating the filled, sealed and labeled bulk containers occurs simultaneously along the length of the conveyor surface of the novel automated filling machine to increase the capacity and output of the automated filling machine.

The novel automated filling machine in the best mode utilizes a novel fill valve nozzle as may be obtained from Cott Technologies Inc. of La Puente, Calif. for dispensing dairy, pharmaceutical and medical products requiring the highest standards in handling. Such valves typically employ a clean in place mechanism and a positive control over the fill material to provide a sanitary and hygienic filling operation for a product filling machine. The valve of the best mode of the invention is of a tapered elongated configuration that may be lowered into the bulk container and raised as the container is filled to provide a more efficient bulk container filling operation. The filling operation can be accomplished by filling by weight or by volume and where precise metering is required an optional weigh scale is provided underneath the bulk filling container to operate a positive control fill valve to dispense a flowable product into the container by weight.

Alternatively, the novel automated bulk filling machine can dispense a fluidized product based upon volume utilizing novel two way and three way and fill valves as may be obtained from Cott Technologies, Inc. of La Puente, Calif. In either embodiment or application of the filling machine the novel automated filling machine provides an efficient, hygienic and completely automated filling, sealing and optional labeling operation for filling containers consistent with the highest standards of food, medicinal and pharmaceutical processing operations. The novel automated filling machine, while in its preferred embodiment may be utilized for bulk filling operations for food, pharmaceutical and medicinal materials, it may also be utilized to fill containers with other frangible, flowable particulate materials such as animal feeds, fertilizers, cat litter, cement and other fluidized or flowable materials.

2. Description Of Related Prior Art

A number of automated bulk filling machines are present in the prior art for filling flexible containers with various types of fill material including food dairy products, seeds, grains, cat litter and pet foods. These bulk containers are generally buckets or tubs made of plastic or metal which include a sealing lip which sealably engages a plastic or metal lid having a corresponding sealing lip for securing the top of the container to the flexible plastic or metal bucket forming the bulk container. Such buckets and tubs are typically in the range of about three gallons to about five gallons of liquid material or holds from about 30 to 50 pounds of particulate material. The larger of the plastic buckets contain lids having a seal strip which provides a second seal for the bulk container which is generally removed by the consumer at the time of the opening of the bulk container.

The automated bulk filling machine of the invention is also advantageously applied to the automated bulk filling of metal cans and containers such as are utilized in holding greases, oils and other lubricants which have a 5 to 25 gallon capacity which are closed with either a metallic or plastic lid.

In such large bulk containers, the lids are generally pressed over the top of the metal bucket or container and the metal or plastic lid is attached to the lip of the bucket to form a seal and a second metal or plastic sealing strip is disposed around the circumference of the lid to provide a sealing tab which is removed by the consumer. Alternatively such large metal pails or buckets can include a metal crimp which is then crimped around the circumference of the lid to a groove in the bucket which is uncrimped by the end consumer.

Such bulk containers in the form of buckets, pails or large cans have been filled through a large bulk filling nozzle by weight or by volume and have traditionally not been automated in a single automated bulk filling machine or operation. Such buckets have been filled manually from a filling nozzle and moved down a conveyor to separate machines for further packaging and subsequent shipment. The best known prior art of such filling processes includes a machine for attaching lids to bulk containers manufactured by Heisler Industries, Inc. Of Fairfield, N.J., in which lids are dispensed down a track and mated at an angle to the container before sealing the lip of the lid to the lip of the container. These prior art machines unlike the invention do not apply the lid in complete registry with the bulk container or press the center of the container to remove excess gas from the interior of the container prior to sealing the container.

The best known prior art includes Naef U.S. Pat. No. 5,466,894, Huck U.S. Pat. No. 5,746,258 and Strand, et al U.S. Pat. Nos. 4,467,845 and 4,420,021. These prior art patents pertain to the dispensation of fluidized bulk materials into bags or containers. Such prior art does not provide a fully automated bulk filling machine or operation as provided by the invention in which a fluidized material is automatically dispensed either by volume or weight into a plastic or metal bucket which is then automatically transferred to a work station for automatically precisely positioning the container before applying the lid and sealing the lid to the bulk container and then moving the sealed container by conveyor to a labeling work station where the container is then labeled and then finally transferring the container by conveyor to an optional accumulation conveyor or device for accumulating the filled, sealed, labeled containers for subsequent disposition on a shipment placket.

Other prior art uncovered includes Bennett, et al. U.S. Pat. No. 5,105,859, which provides an automatic filling machine for filling containers with a time flow volumetric liquid of a predetermined quantity. Bennett, et al. U.S. Pat. No. 5,105,859 does not provide for both the filling of containers and the application of the lid in a single machine.

Launay U.S. Pat. No. 4,293,049 pertains to a bulk filling machine for filling bulk containers with a product such as ice cream. The metering and balancing device of Launay U.S. Pat. No. 4,293,049 does not provide a fully automated process of filling, applying a lid, sealing, labeling and optionally accumulating bulk containers in a fully automated process. None of the known prior art teaches or suggests a single fully automated bulk filling machine having the ability to provide a plurality of work stations in which the sequential separation and advancement of a bulk container from a stack of bulk containers is achieved at one station while the filling of another bulk container occurs at another station while a previously filled container is being sealed at another station while a previously filled and sealed container is optionally labeled at a further station. None of the prior art further teaches or suggests the utilization of an indexing and conveyor system in combination with a lid application device which accurately positions the container on the conveyor before automatically placing a lid in flat registry with the container before sealing the container.

None of the prior art teaches or suggests the application of a sealing lid by the automatic advancement of a lid from a lid dispensing device to deposit the lid on the top of the bulk container and then provide for a piston cylinder combination for pushing down the center of the lid over the bulk container to not only place the lid on the container but also to assist in the removal of excess air between the lid of the container and the container before applying pressure to the periphery of the container to seal the container while limiting lateral expansion of the sides of the lid to prevent damage to the lid and seal. The removal of excess air and the sealing of the container by forcing the interlocking lips and grooves of the lid and the container prior to the sealing of the container not only assists in the sealing of the container but also reduces the atmospheric gases and pressure in the container to provide a bulk container with a decreased volume of air inside the container to provide a superior packaged product.

SUMMARY OF THE INVENTION

The invention pertains to an automated filling and sealing machine and method for filling and sealing containers in which one or more containers are automatically filled by weight or by volume at a filling station at one end of the filling machine while one or more previously filled containers are being sealed at a sealing station on the novel filling machine while one or more containers are being labeled at a labeling station on the novel filling machine while one or more other containers are being accumulated or transported from the other end of the novel bulk filling machine. The novel filling machine is particularly applicable to bulk containers and provides a compact, efficient, automated filling, sealing, labeling and conveying apparatus for automatically filling, sealing and optionally labeling containers. The efficiency of the novel bulk filling machine and method of the invention is achieved by employing a plurality of work stations along the length of a conveyor for completing a plurality of operating processes necessary for separation, filling and handling of bulk containers in a highly efficient and automated processing operation.

The novel automated filling machine includes at the input end, a conveyor for receiving a bulk container for receiving a flowable or fluidized material through a dispensing nozzle disposed above the conveyor. In the best mode of the invention an optional container separation station is provided for separating each bulk container from a stack of bulk containers before introducing the separated bulk container to the conveyor. The separation of a bulk container from a stack of bulk containers is indexed or coordinated with the filling, sealing and any optional handling operations on the container on the novel bulk filling machine.

The dispensing nozzle meters a fluidized material into the bulk container on either a by volume or by weight fill. The fluidized material can be any type of flowable material such as liquid, gel, colloid or fluidized particulate matter for dispensation into the bulk container. In the case of dispensing fluid products by volume, a homogeneous mixture of fluid or flowable material is dispensed through the nozzle at a constant rate to provide the required volume of bulk material in the container. In an alternative embodiment of the invention, the bulk container can be filled by weight in which case a scale may be disposed below the bulk container which takes the tare weight of the bulk container and controls the precise metering of the fluidized material into the bulk container to the predetermined weight. In the best mode of the invention the dispensing nozzle is of a tapered or elongated configuration that may be lowered into the bulk container and raised during the filling operation to reduce sloshing and frothing in the case of liquid materials and dust in the case of particulate material and air pockets in the case of heavy viscous materials to more efficiently fill the bulk container from the bottom to the top.

Once the bulk container has been filled by weight or volume the conveyor device is started and the container is automatically transported to a sealing station where the filled container is precisely positioned on the conveyor before a lid is placed over the top of the container so that the lip of the bulk container is in complete registry with the mating groove of the lid. The lid is transported by a shuttle assembly operated by a piston to set the lid in a precise location centered directly over the bulk container. A piston carrying the lid attachment mechanism is then advanced toward the center of the bulk container lid resulting in a lid pad carried at the center of the lid attachment mechanism to first contact the center of the bulk container lid causing the bulk container lid to deform at the center of the lid to force air from the container around the periphery of the lid prior to the advancement of a frame on the lid attachment mechanism for pressing the lip of the bulk container into the groove of the lip to seal the lid onto the top of the container.

Simultaneous with the attachment and sealing of the lid to the previously filled bulk container a new bulk container is optionally separated from a stack of bulk containers while a previously separated container is advanced and filled at the filling station of the novel bulk filling machine. Once the separating, filling and sealing operations are complete the conveyor again moves to advance the previously sealed container to an optional labeling station while the previously filled container is moved to the sealing station and a new container is optionally separated and advanced to the filling station. At the optional labeling station, a label is applied to the outside of the container as the bulk container is rotated on the conveyor belt and while the previously filled container is positioned and then sealed and a new container is being filled at the filling station of the novel bulk filling machine. As will be recognized by those skilled in the art bulk containers may already contain labels that are painted, embossed or otherwise already attached to the bulk container which may be filled and sealed in the novel automated filling machine without utilizing the optional labeling station.

Thereafter the optional separation station separates a new bulk container and advances the separated container to the conveyor of the novel bulk filling machine which is then also again advanced to receive a new bulk container at the filling station while a previously filled container is advanced to the sealing station and the previous sealed container is advanced to the optional labeling station and the previously labeled container is either removed from the conveyor of the novel bulk filler machine or is accumulated in and optional accumulator device for accumulating bulk containers in a predetermined set of bulk containers in a number compatible for deployment for a particular shipping pallet. In some cases the optional accumulation device may accumulate bulk containers in sets of twos or fours or any other particular number prior to releasing the containers in a bulk array desired for a particular type of shipping pallet.

The optional accumulation device may be configured in a variety of ways and can be in the form of a U-shaped rail pivotally mounted near the center of the novel bulk filling machine and attached at the other end by a piston cylinder combination for elevationally pivoting the U-shaped accumulator rail away from the novel bulk filler machine conveyor bed to allow a predetermined number of filled, sealed and labeled containers to be removed in groups from the novel bulk filler machine.

The intermittent operation of the conveyor of the novel bulk filler machine and the bulk container separation device may be provided by one or more drive motors for separating and advancing the bulk containers on an optional bulk container separating device or it may include a single drive motor for driving the container separation device as well as driving the conveyor bed through a drive chain and sprockets for transporting bulk containers from the filling station to the sealing station and to the labeling station and out from the output end of the novel bulk filler machine. The novel bulk filler machine also preferably includes a fully automated control system for controlling the separation, advancement, filling, sealing and labeling operations of the bulk filling operation so that floor space and labor are kept to a minimum in the automatic filling of bulk containers.

More particularly the optional bulk container separation and advancement device includes at the inlet end an upstand for receiving and holding a plurality of stacked bulk containers. A first pair of laterally adjacent bulk container lip latching mechanisms are designed to periodically stabilize and hold the stack of bulk containers at the lip. The first pair of laterally adjacent lip latching mechanisms are preferably activated by a piston cylinder combination while other arrangements of latches and rachet and pawl mechanisms and devices may be utilized.

A second pair of laterally adjacent bulk container latching mechanisms disposed axially adjacent to the first pair of lip latching mechanisms are provided to periodically stabilize and hold the stack of bulk containers at the lip of the bulk container. The second pair of laterally adjacent lip latching mechanisms are also preferably activated by a piston cylinder combination although like the first pair of laterally adjacent lip latching mechanisms other mechanical arrangements of latches and rachet mechanisms may be utilized.

The first pair of laterally adjacent bulk container lip latching mechanisms cooperate with the second set of laterally adjacent lip latching mechanisms to periodically stabilize and hold the stack of bulk containers. In operation the release of the first pair of laterally adjacent bulk container lip latching mechanisms lowers the stack of the bulk containers to the second pair of laterally adjacent bulk container latching mechanisms. The first pair of laterally adjacent bulk container lip mechanisms is then activated to engage the lip of the next successive bulk container and the second pair of lip latching mechanisms are released to allow the previous bulk container to be removed from the bottom of the stack. A pair of vertically disposed cylinders with lip engagement means is preferably utilized to push the bulk container into the inlet of the novel bulk filling machine.

Once the bulk containers are denested from the nested stack of containers the bulk containers are preferably engaged by a timing chain including paddles to precisely locate the bulk containers on the conveyor from the bulk container denesting or separation device to the filling station, optional weigh station and to the lidding station. The timing chain with equally spaced paddles or rods together with sensors detect the bulk container and a micro switch operates the fill nozzle only after the bulk container has been detected in the proper position. The combination of sensors and microswitches makes certain fill materials are not released from the nozzle unless the bucket is in proper position and that the later optional weighing of the container does not take place until the filled bulk container is properly positioned.

The denesting and separation of bulk containers is preferably also controlled by sensors and microswitches to make certain that only when space is available between the rods or paddles in the indexing cycle is the next bulk container dropped onto the conveyor platform. This prevents the denester or separation mechanism from operating until the cycle is complete and space is available for the next bulk container.

The filling station preferably includes electronic means for opening and closing the nozzle for metering bulk materials into the bulk container. The electronic means for metering bulk materials into the container can be activated by a volumetric control for metering homogeneous fluidized materials into a bulk container by keeping the nozzle open for a predetermined period of time to meter a fluid material into a bulk container. Alternatively, the electronic means can control the opening and closing of the nozzle based on weight where greater control is required over the amount of bulk material dispensed. A weigh scale is preferably provided below the bulk container to provide a tare weight of the empty container and thereafter fill the container precisely to a predetermined fill weight to precisely control the amount of material dispensed in the bulk container.

The nozzle controlled by the electronic means at the filling station in the best mode is of an elongated tapered configuration which may flare at the end to assist in providing for the efficient filling of the bulk container. The nozzle in the best mode is raised and lowered by a piston cylinder combination to allow bulk material to be introduced first into the bottom of the container and as the container is filled the nozzle is gradually elevated as the bulk container is filled. The movement of the nozzle is coordinated with the filling of the container to increase the efficiency in filling the bulk containers with particulate matter such as soap or flour and in reducing frothing, sloshing and aeration in the case of liquids such as milk and in reducing air voids in the case of thick substances such as frozen ice cream or yogurt.

The electronic means for controlling the fill is further coupled to the optional device for removing and advancing bulk containers from the bulk container stack as well as the means for activating the piston for the sealing operation so that the time for the precise positioning and sealing of one container and the filling of another container is coordinated with the removal and advancement of the bulk containers from the stack of bulk containers. Similarly the electronic control means controls the time for the optional labeling of the container but since the labeling of the container is less than the time for sealing, the rate determinative time is generally the time needed either to fill or position and seal the bulk container which controls the operation of the electric motor for operating the conveyor to advance the containers through the various stations of the novel bulk filler machine. The time required to fill the bulk container is dependent upon the composition of the bulk material so that automated bulk filling machines with a single fill valve in test operations have filled about 10 to 15 bulk containers per minute.

Optionally, the novel bulk filler machine can include an optional accumulation device and an optional gassing apparatus for modifying the atmosphere inside the bulk sealed container before it is sealed. Additionally the novel bulk filler machine may include additional operating stations for treating or processing bulk materials in the container as may be desired in particular bulk filling operations. Such optional stations can include vibration stations, supplemental fill stations or supplemental weigh stations or additive stations for adding additional ingredients as well as supplemental weigh stations along the length of the novel bulk filler machine.

The optional gassing station may be provided at or before the sealing station for modifying the atmosphere in the bulk container before the placement of the lid in registry over the top of the bulk container and the novel attachment of the lid of the bulk container by first pressing the center of the lid of the bulk container to assist in the removal of excess gas. The procedure of first pressing the center of the lid not only assists in the removal of excess gas but also assists in deforming the lid of the container before pressing the rim of the container down into the lip of the bulk container.

The optional accumulation device may also be provided by employing a U-shaped rail for accumulating a desired number of filled, sealed and labeled containers before they are transported in a particular array to a shipment pallet. For example, the shipment array may require sets of two bulk containers or four bulk containers in a group and the U-shaped accumulation device accumulates the containers in the desired number prior to releasing them in the desired array.

The accumulation device can be in the form of a U-shaped rail which is pivotally attached at one end to the novel bulk filler machine and includes at the other end a piston cylinder combination for elevating one end of the U-shaped rail away from the conveyor belt of the novel bulk filler machine to allow groups of containers to be transported from the novel bulk filler machine in a desired array while other bulk containers are being simultaneously moved from filling station to the sealing station and to the labeling stations of the novel bulk filler machine.

The method of filling bulk containers of the invention provides for the simultaneous filling of at least one bulk container by weight or by volume while a previously filled bulk container is simultaneously sealed by first placing the bulk container lid in registry with the lip of the bulk container around the entire perimeter or circumference of the lid before first applying pressure to the center of the lid to force excess gas or fluid from the bulk container before press fitting the mating groove of the lid onto and over the lip of the bulk container. The method of the invention preferably also includes means for precisely positioning the bulk container on the conveyor prior to placing the lid in registry with the lip of the container. The method of the invention also preferably includes automatic removal of a bulk container from the bottom of a stack of bulk containers and delivering the removed bulk container to the inlet of the novel automated bulk filling machine as needed in the automated filling and sealing operation.

The method of the invention optionally further provides for the automatic labeling of a third group of containers at a labeling station as well as the optional accumulation of a further group of containers while providing for the simultaneous filling and sealing of other groups of bulk containers. The method further includes the optional provision for providing for gassing, agitating and adding additional fill or additives stations at other locations along a production line provided by the novel bulk filling machine where groups of containers are simultaneously processed.

BRIEF DESCRIPTION OF THE DRAWINGS

The objects and advantages of the invention will become apparent to those skilled in the art from the following detailed description of the preferred embodiment when read in conjunction with the accompanying drawings in which.

DETAILED DESCRIPTION OF THE PREFERRED EMBODIMENT

Figure 1:
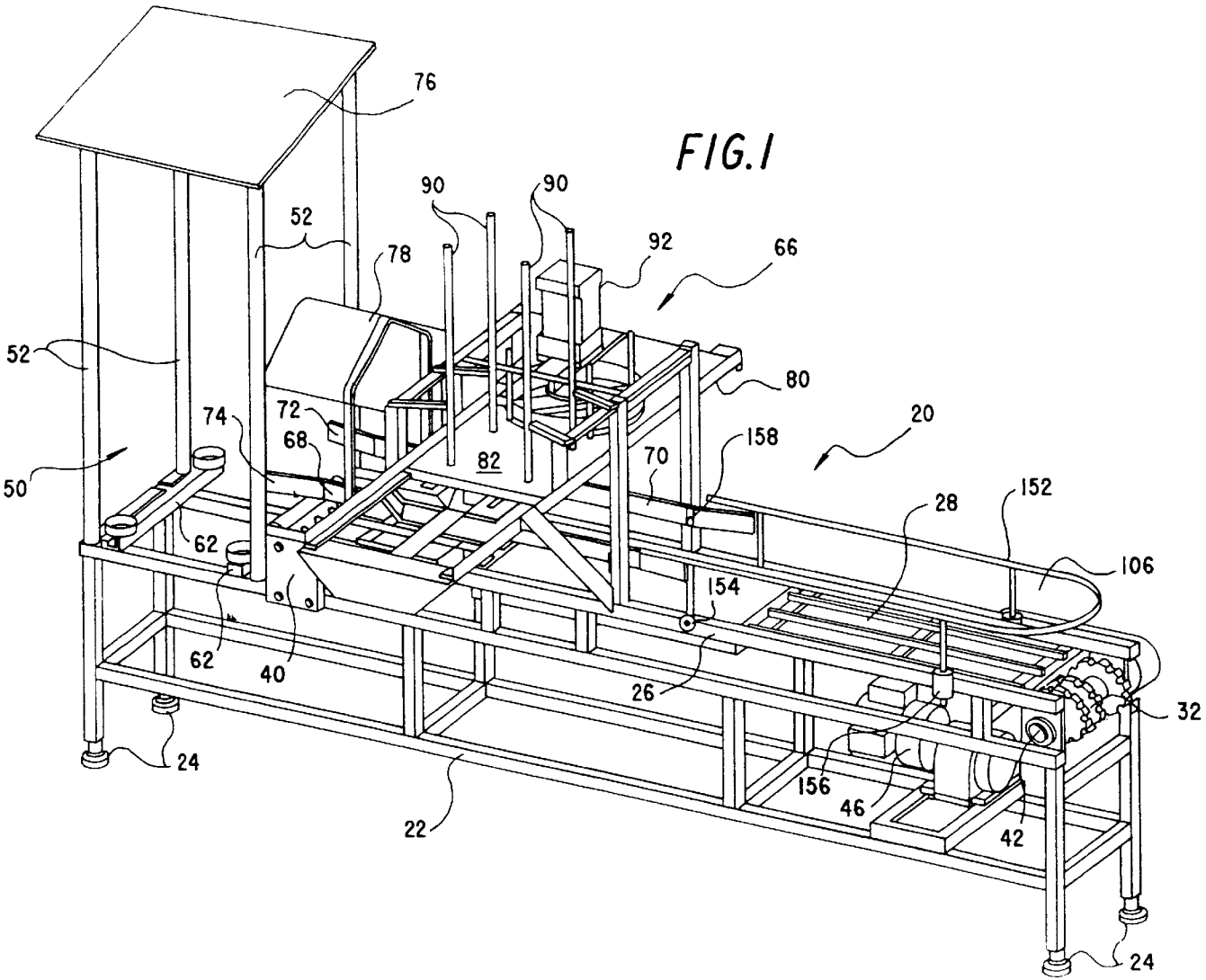
FIG. 1 is an isometric view of the novel bulk filler machine with the conveyor belt removed to better illustrate the components of the novel bulk filler machine in accordance with the preferred embodiment of the invention.
Figure 2:
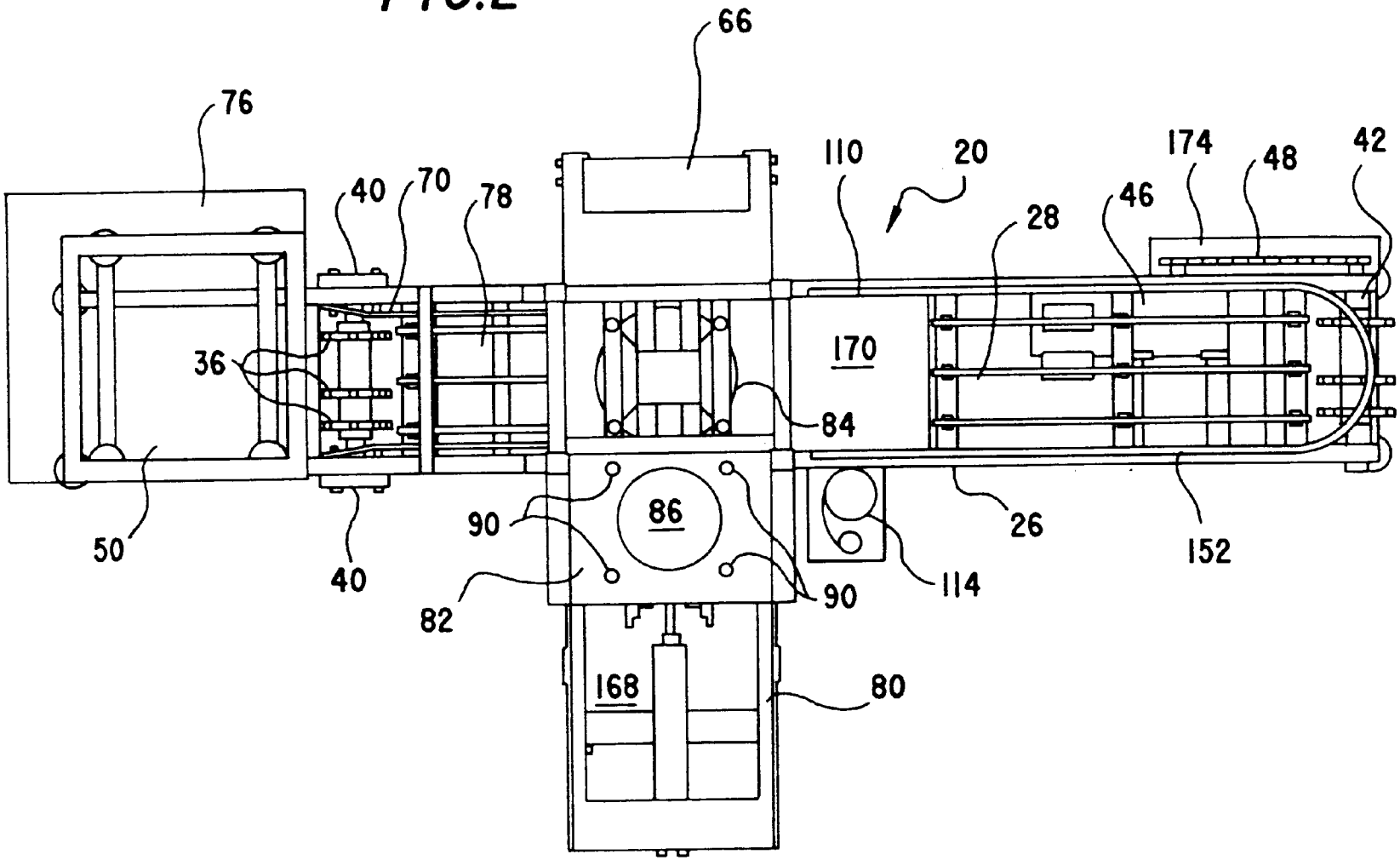
FIG. 2 is a top plan view of the novel bulk filler machine of FIG. 1.

The novel bulk filler machine and method is designed to provide automatic separation, indexing or advancement, filling and sealing with optional gassing, labeling and accumulation of bulk containers such as are employed to carry products to the consumer in bulk pails or buckets for end use. Such pails and buckets are generally in the neighborhood of a capacity of one gallon to 20 gallons of fluid materials or fluidized powders or materials having weights anywhere from one to one hundred pounds that are dispensed and shipped in buckets, pails or tubs for bulk shipment to the consumer. The novel bulk filling machine and method provides for a compact single machine production line for the automatic filling of a container based on weight or volume by the utilization of a filler dispensing nozzle in combination with the bulk filling machine which includes a filling station and a sealing station and optional bulk container separation and advancement of individual bulk containers, labeling, gassing, weighing and accumulation stations disposed along the length of the automated bulk filling machine.

The novel automated bulk filling machine is designed to operate with the minimum of human labor and maintenance requirements as well as provide for the highest standards in purity for the dispensation of a wide range of bulk products into bulk containers. These standards are achieved by the utilization of clean in place nozzles in dispensing apparatus as well as the stainless steel construction of the machine to foster cleaning of the entire machine consistent with the highest standards of purity.

The novel automated bulk filling machine and method at one end of the spectrum can be utilized to automatically dispense fluidized powder materials within a protective closure to reduce dust and airborne particles while providing for the weighing or volumetric dispensation of the product without the necessity of the presence of humans in the environment. At the other end of the spectrum the novel automated bulk filling machine provides for the sanitary and hygienic dispensation of dairy products such as ice cream, cream cheeses and other material in the range of 1 gallon to 50 gallons that require the utmost care in handling since the nozzle and novel automated bulk filling machine is made of stainless steel to allow the entire automated bulk filling machine to be rapidly cleaned to provide the highest standards and hygienic handling of food, pharmaceutical and medicinal materials.

Referring now to FIGS. 1–5, the novel bulk filling machine 20 is illustrated having a conveyor support frame 22 which is supported by adjustable feet 24. Adjustable feet 24 provide an important function in leveling the conveyor support frame 22 which is particularly important where weighing of the dispensed bulk fill product is provided at a weigh station as will be discussed hereinafter in greater detail.

Conveyor support frame 22 supports a conveyor frame 26 which provides a bed 28 for a conveyor belt 30 (FIG. 6) which is disposed along the length of the conveyor frame 26 and operated by drive sprockets 32 in combination with idler sprockets 36 (FIGS. 2 and 4) to transport and support containers 38. Idler sprockets 36 are journaled to conveyor frame 26 in a journal assembly 40 and drive sprockets 32 are journaled to conveyor frame 26 through a drive shaft 42 through a bearing 44. Drive shaft 42 is driven by motor 46 by a drive chain 48 to drive the conveyor belt 30. Motor 46 intermittently drives conveyor belt 30 to advance bulk containers 38 from a filling station to a sealing station and then to an optional labeling station and accumulation station as will be hereinafter described in greater detail.

The novel bulk filler machine at the input end 50 includes four support tubes 52 which define a filling station for receiving a product fill nozzle 54 (FIG. 8) for dispensing a bulk product. A bulk product is supplied to the product fill nozzle 54 through a supply conduit 56. The product fill nozzle can be a standard product fill nozzle such as available from various suppliers but is preferably a hygienic fill nozzle such as manufactured by Cott Technologies of City of Industry of California under the model designation Model No. 762-227 (2 inch) or three way fill valve Model No. 762-228 (2 inch). The hygienic fill nozzle from Cott Technologies is preferred particularly where clean in place capabilities are required or where the product dispensed is a food, medical or pharmaceutical product where the highest care in product handling.

The product fill nozzle may include an optional mixing motor device 58 for maintaining the product in the product fill nozzle in a fluidized homogeneous condition for dispensing through product fill nozzle based upon either a volumetric dispensation of the product or a by weight dispensation of the product as will be described hereinafter in greater detail.

Figure 9:
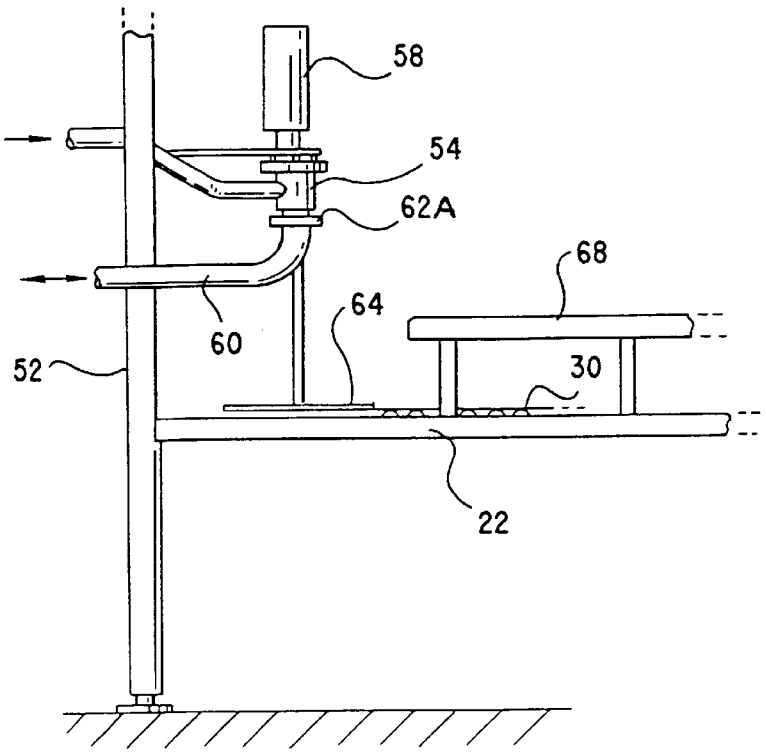
FIG. 9 is a fragmentary side elevational view similar to FIG. 8 illustrating the application of a clean in place apparatus for the bulk filler nozzle.

In the best mode of the invention the entire frame, filling nozzles, container centering and lid attachment assembly are made of stainless steel and are devoid of welds, threads or other surface imperfections that would prevent sanitizing the entire automated bulk filling machine. In addition, the Teflon® or Delrin® plastic components, such as are utilized in the conveyor bed assembly, as will be discussed hereinafter in greater detail are made of Teflon®, Delrin® or a Teflon®/Delrin® combination which allows the entire assembly to be cleaned and sanitized to the highest food processing, medicinal and pharmaceutical handling standards as are available in the industry. Further, the nozzles supply conduit 56 and clean-in-place conduit 60 (FIG. 9) are also constructed of stainless steel and include flanges 62A for attaching to product fill nozzle 54 to provide clean-in-place capabilities for nozzle 54 and components in the input end 50 of the automated bulk filling machine.

Figure 8:
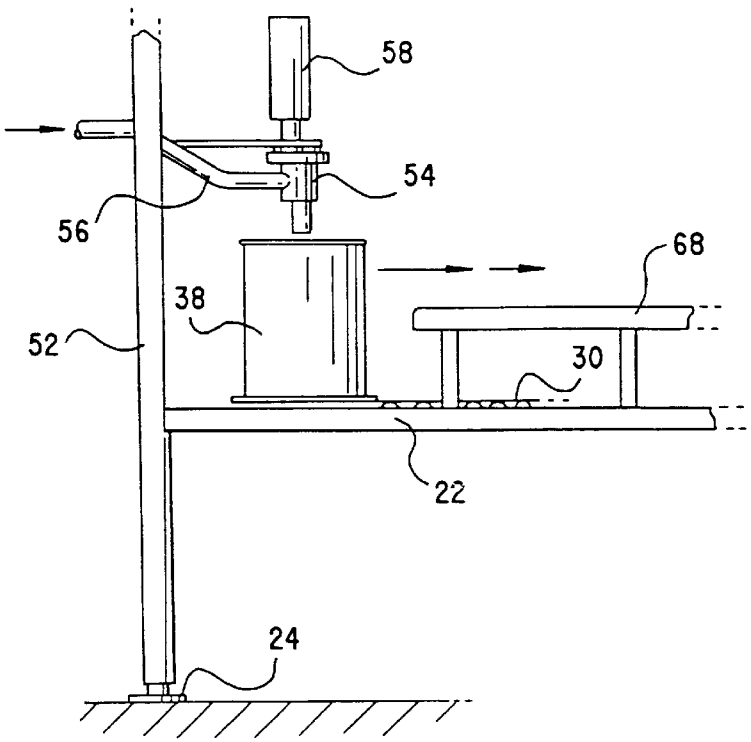
FIG. 8 is a fragmentary side elevational view of the fill station of the novel bulk filling machine.

The automated bulk filling machine at input end 50 includes a support frame 62 for receiving bulk containers 38 (FIG. 8) into the input end 50. Container 38 may be filled as illustrated in FIG. 8 by volume in which case product fill nozzle is maintained in an open position for a predetermined period of time to dispense a predetermined quantity of a fluidized material into container 38. Alternatively, support frame 62 can support a scale 64 (FIG. 9) for weighing the weight of fluidized material dispensed through product fill nozzle 54. In either case, once container 38 is filled by volume or by weight, container 38 is conveyed by conveyor belt 30 from input end to the lid attachment station 66 (FIG. 1), while a subsequent container is conveyed to the input end 50 for simultaneous filling.

Prior to the attachment of the lid the container 38 is first roughly centered on conveyor belt 30 by a pair of flanged guide rails 68 and 70 having inwardly tapering arms 72 and 74 for directing and positioning container 38 in rough alignment with the container centering and lid attachment assembly 98 for dispensing and attaching lids to the top of the container 38 as will be described hereinafter in greater detail.

The automated bulk filling machine may optionally include a canopy cover 76 at input end 50 as well as a conveyor canopy cover 78 for preventing contamination of containers 38 filled in the novel automated bulk filling machine. Optionally, input end canopy cover 76 and conveyor canopy cover 78 can also be used to support a closure curtain for closing the input end of the bulk filling machine from surrounding areas to not only prevent dirt and dust from entering the input end 50 of the filling machine, but also to prevent dust particles from exiting the input end 50 where the bulk container is filled with a dusty particulate material.

Figure 14:
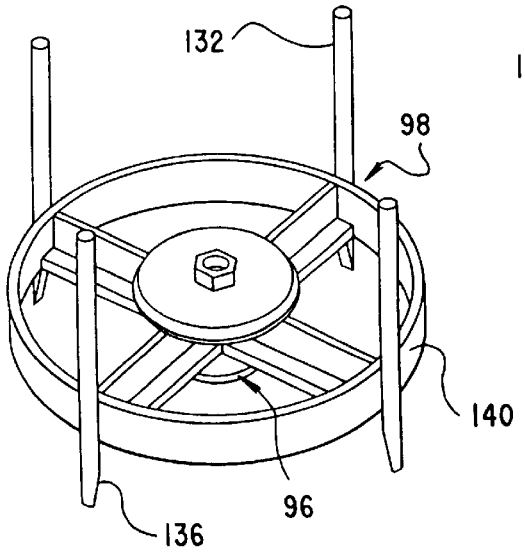
FIG. 14 is a perspective view of a container centering and lid attachment assembly constructed in accordance with the preferred embodiment of the invention.
Figure 15:
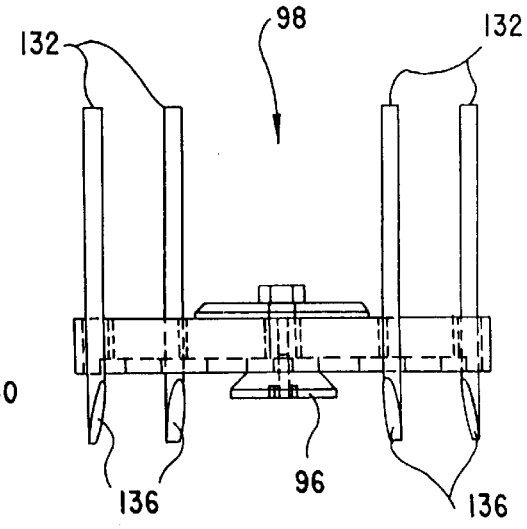
FIG. 15 is a side elevational view of the container centering and lid attachment assembly of FIG. 14.
Figure 17:
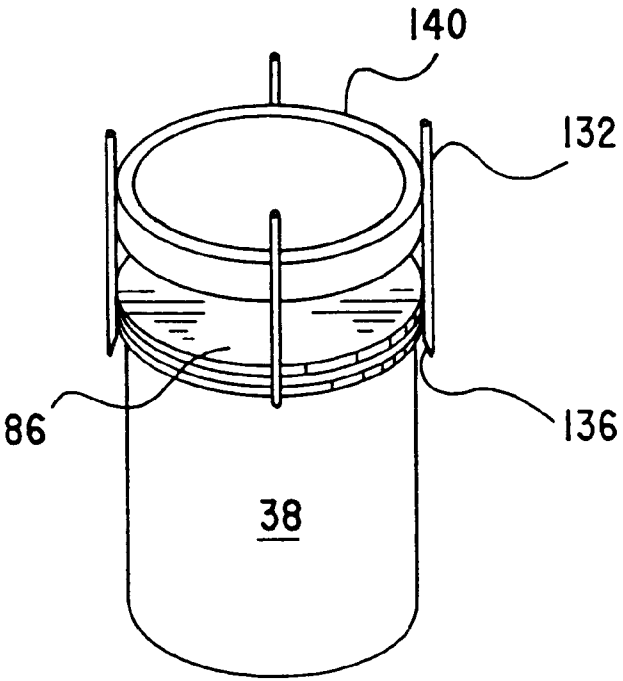
FIGS. 16 and 17 are perspective views illustrating the operation of the container centering and lid attachment assembly of FIG. 14.
Figure 16:
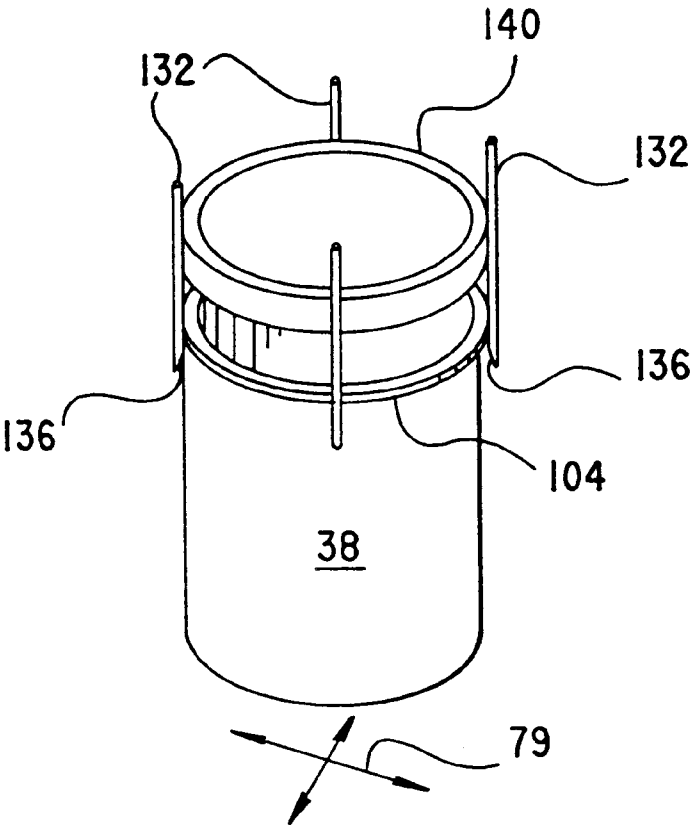

Once a container 38 is in place at the lid attachment station 66 and roughly positioned on the conveyor belt 30 by tapering arms 72 and 74 and guide rails 68 and 70 the conveyor belt 30 then stops to allow a new container to be filled in the input end 50. At the same time the previously filled container is first precisely positioned on the conveyor and a lid is attached to the filled container at the lid attachment station 66. The container 38 is precisely positioned on the conveyor 30 at the lid attachment station by the activation of the lid attachment piston 100 from container centering and lid attachment cylinder 92. The advancement of piston 100 from cylinder 92 advances assembly 98 (FIG. 14) toward empty container 38 resulting in the tapered ends 136 of the centering and securing rods 132 first contacting the lip 104 of container 38 (FIG. 16) and precisely centering container 38 on conveyor belt 30 as represented by centering arrows 79. Once container 38 is precisely positioned on conveyor 30 piston 100 is retracted in cylinder 92 and a lid 86 is advanced and deposited on container 38 in registry with lip 104.

Figure 3:
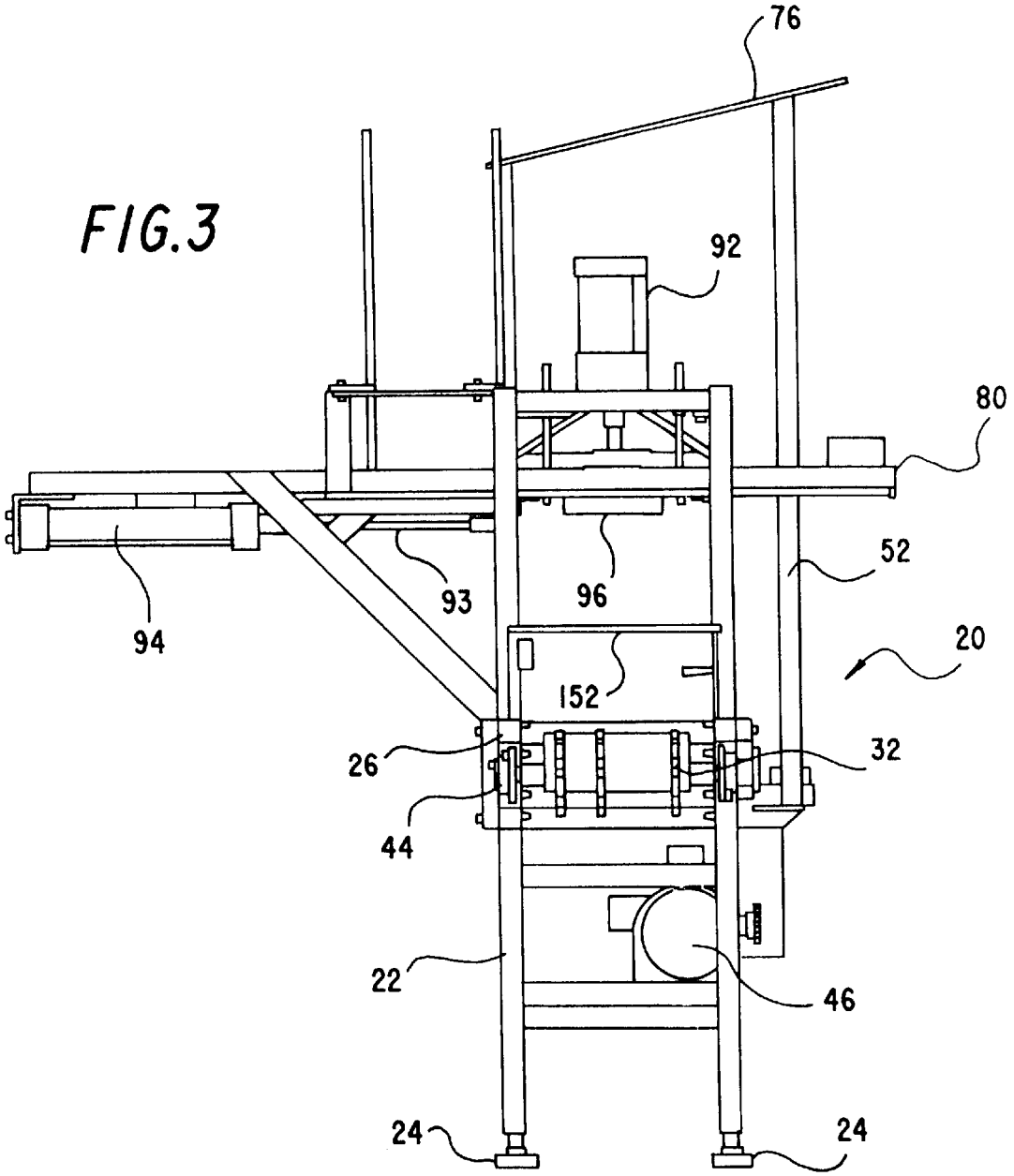
FIG. 3 is a right side elevational view of the novel filler machine from the output end of FIG. 1.
Figure 4:
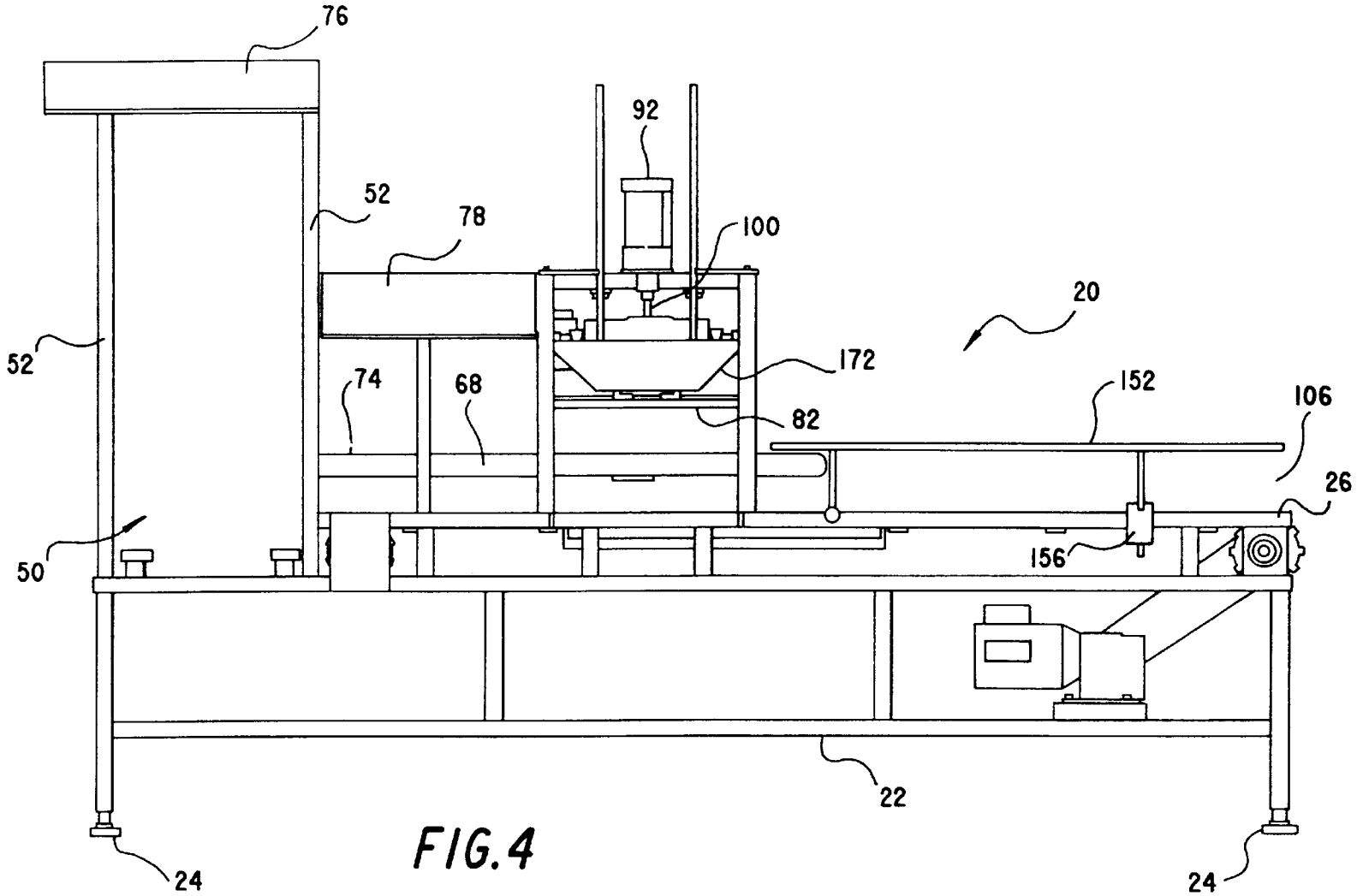
FIG. 4 is a front side elevational view of the novel bulk filler machine of FIG. 1.
Figure 5:
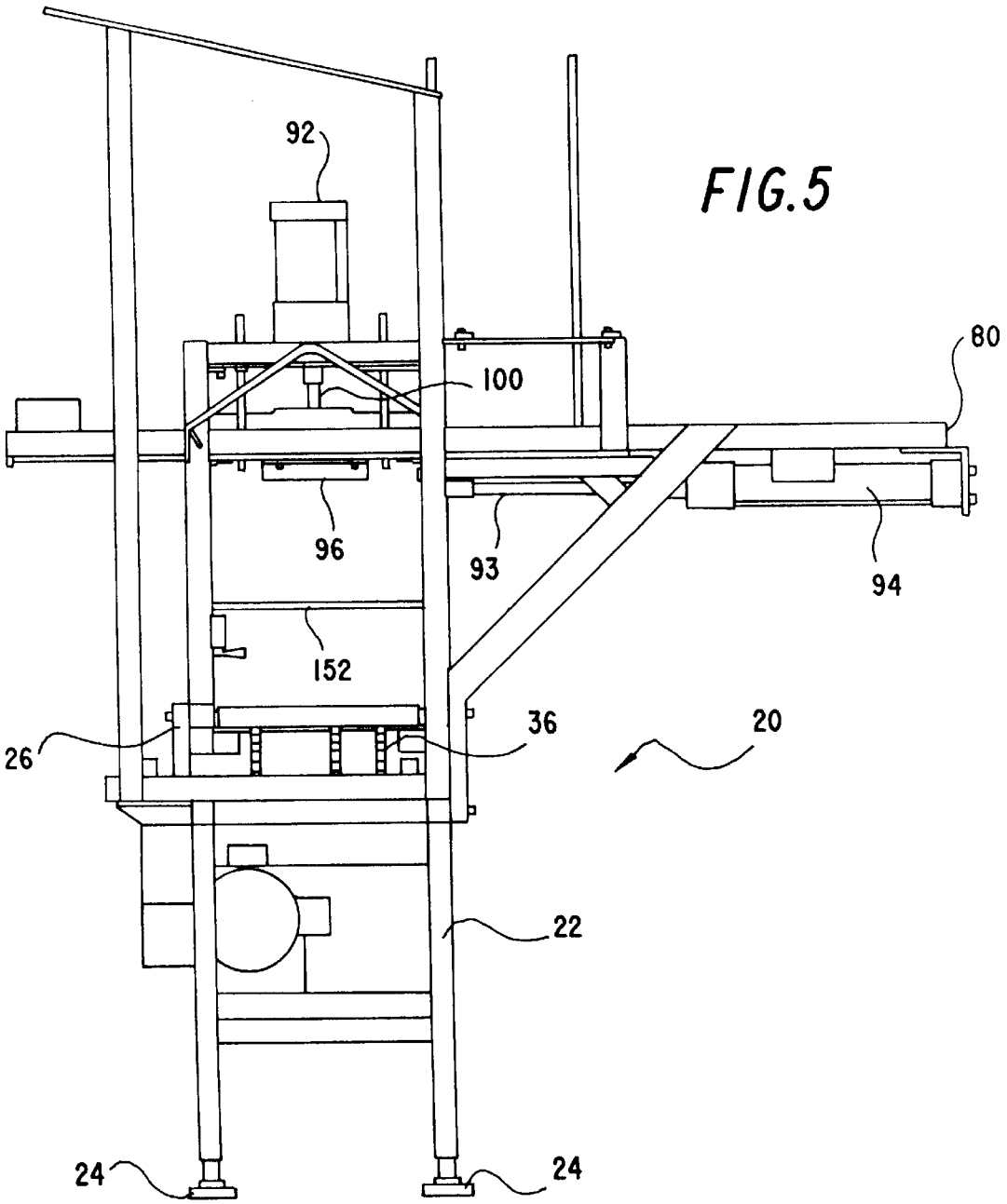
FIG. 5 is a left side elevational view of the novel bulk filler machine of FIG. 1.
Figure 12:
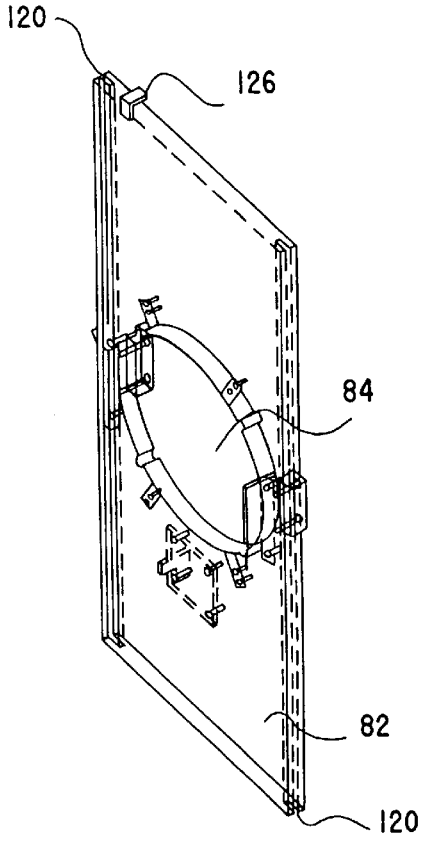
FIG. 12 is a perspective view of a lid conveyor constructed in accordance with the preferred embodiment of the invention.

The lid attachment station 66 includes a lid attachment support bed 80 and a conveyor bed 82 (FIGS. 1 and 12). Conveyor bed 82 includes a circular opening 84 (FIG. 2) for receiving a container lid 86 (FIGS. 1 and 2) held in place by four lid guide rods 90 disposed above conveyor bed 82. Conveyor bed 82 is slidably disposed in lid attachment support bed 80 and is designed to travel between container lids 86 supply formed by four guide rods 90 and cylinder 92 by conveyor bed actuator piston 93 actuated by conveyor bed actuator cylinder 94 (FIGS. 3 and 5). Lids 86 are gravity fed and captured by the four lid guide rods 90 until circular opening 84 is in registry with one of the lids causing the lids to drop into circular opening 84 and be advanced by conveyor bed actuator cylinder 94 into perpendicular alignment with lid attachment cylinder 92.

Figure 7:
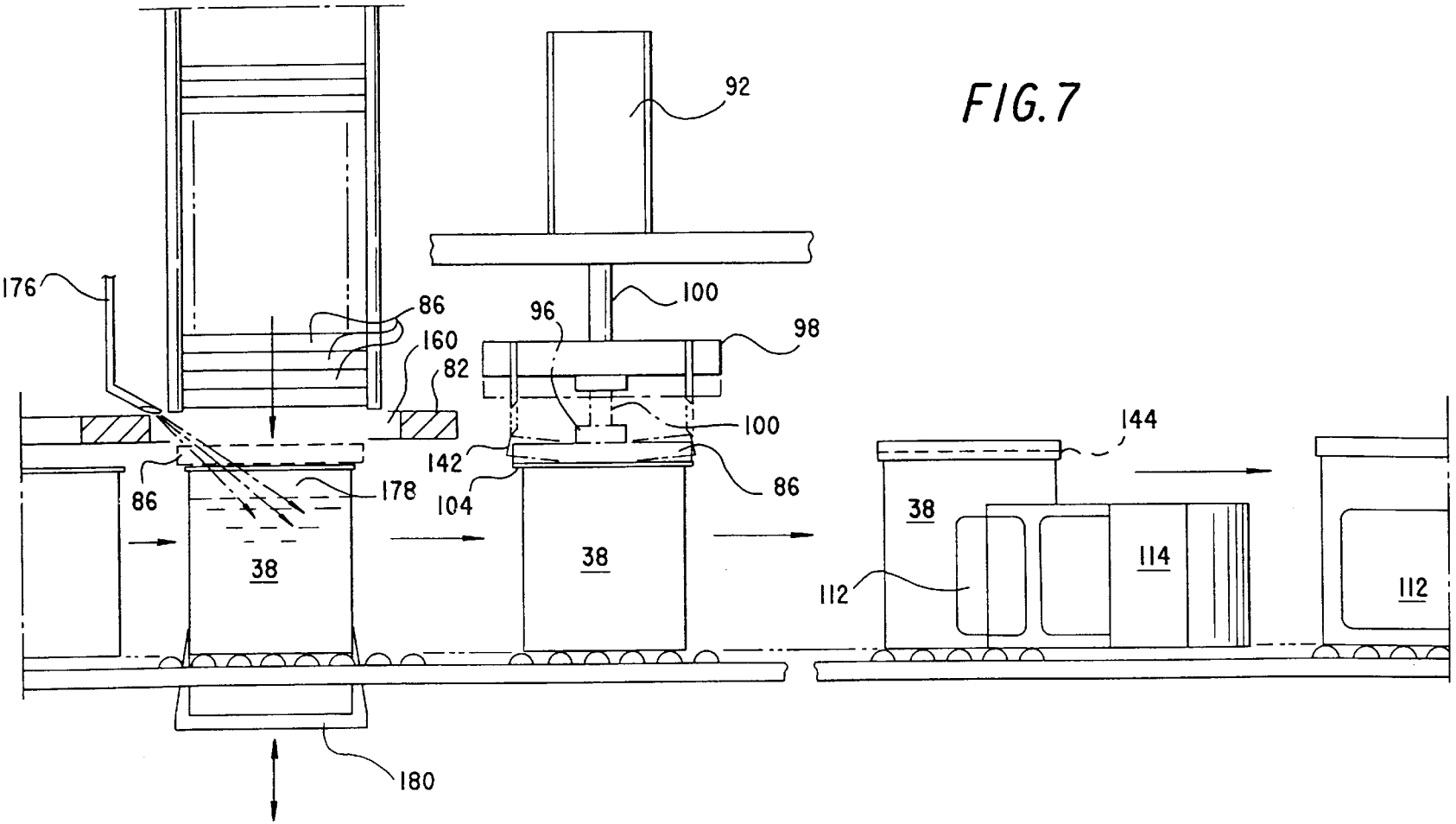
FIG. 7 is a schematic side elevational view illustrating a further alternative embodiment for an optional gassing and the application of lids to the filled bulk containers in accordance with the invention.
Figure 10:
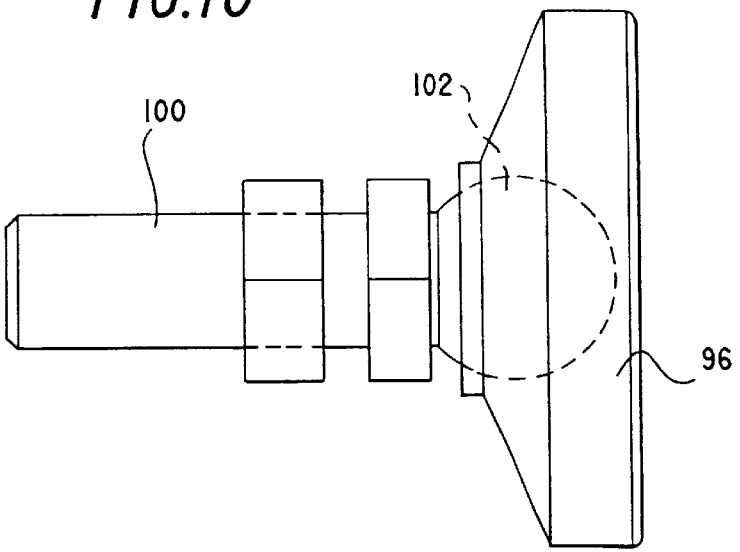
FIG. 10 is a side view illustrating a lid leveling pad.
Figure 11:
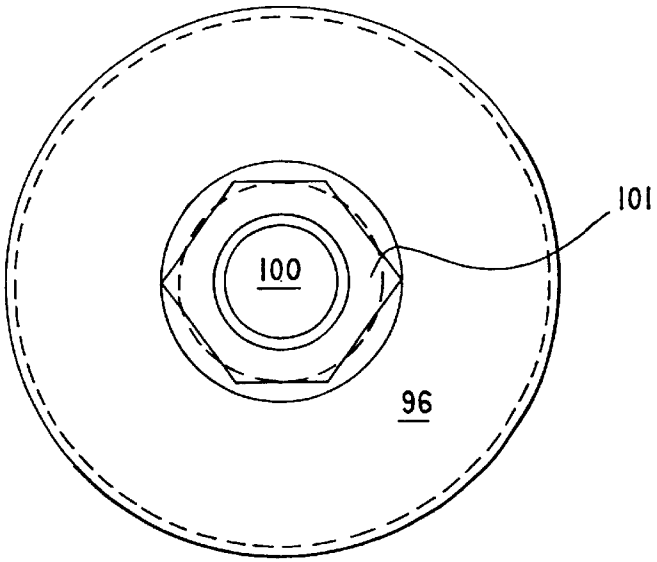
FIG. 11 is a top plan view of the leveling pad of FIG. 10.

Once one of the lids 86 in circular opening 84 is advanced in perpendicular alignment with lid attachment cylinder 92, cylinder 92 is activated to advance piston 100 to advance container centering and lid attachment assembly and push lid 86 from opening 84 by the advancement of securing rods and tapered ends 136 through grooves 130 of conveyor bed 82 (FIGS. 12 and 13) and deposit lid 36 in substantially flat registry with lip 104 of container 38. Further advancement of piston 100 results in the advancement of deforming pad or leveling pad 96 (FIGS. 3, 5 and 10) onto the center of lid 86 causing the deformation of lid 86 as illustrated in FIG. 7. Leveling pad 96 is designed to first contact the center of the lid 86 and deform the center of the lid 86 downwardly toward the center of container 38 to force air out of the sides of container 38 before the ring shaped frame 140 (FIG. 14) of the lid attachment assembly 98 presses the perimeter of the lid 86 onto and over the lip 104 of the container 38.

Leveling pad 96 is preferably made of Delrin®, Teflon® or other plastic material, which is pivotally attached to container centering and lid attachment assembly 98 by bolt 101 through a pivot bearing 102. Pivot bearing 102, in combination with leveling pad 96, assists in deforming the center of the lid 86 and the slipping of the lip of the lid with a tear tab over the lip 104 of container 38 after pressing the center of the lid to remove excess gas from container 38. The further advancement of the lid attachment assembly 98 results in the ring 140 securing lid 86 to lip 104 of container 38 while the securing rods 132 assist in spreading lateral forces around the perimeter of the lid to prevent damage to the lid as well as assisting in maintaining the integrity of the tear tab 144 on the side of the lid 86.

Once the lid 86 is attached to the container 38, cylinder 92 retracts piston 93 to retract lid attachment assembly 98 and deforming pad 96 through circular opening 84 and conveyor bed 82 is moved by conveyor bed actuator cylinder 94 so that circular opening 84 is in registry with one of the container lids 86 to pick up a new lid held in place on top of conveyor bed 82 and held in place by the four lid guide rods 90.

Figure 13:
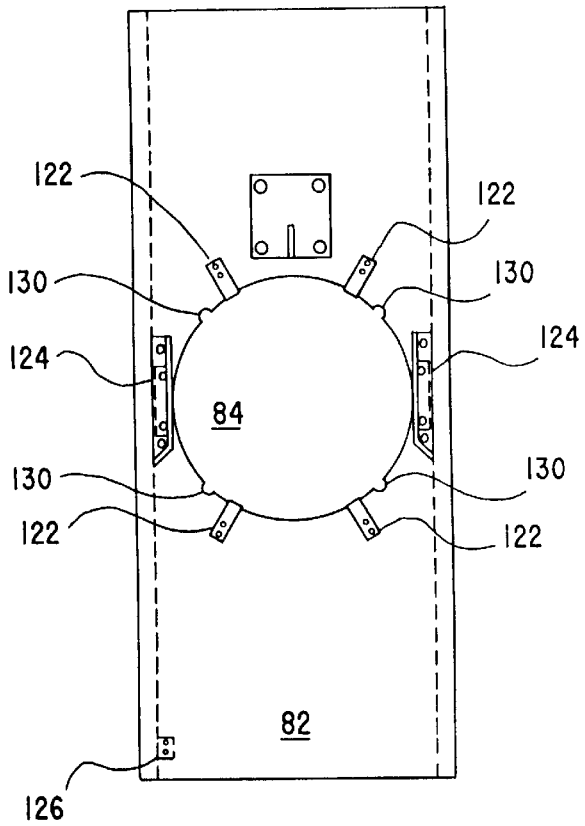
FIG. 13 is a bottom plan view of the lid conveyor of FIG. 12.

Referring now to FIGS. 12 and 13, conveyor bed 82 is illustrated in greater detail. Conveyor bed 82 includes a pair of slots 120 for slidable engagement on lid attachment support bed 80. Conveyor bed 82 includes four spring clips 122 for holding a lid 86 in opening 84. A pair of lid guides 124 are exposed on laterally adjacent sides of opening 84 to assist in maintaining the lid in a level position in opening 84 as conveyor bed 82 travels from a position in registry with the column of lids 86 held by the four lid guide rods 90 to a position below lid attachment assembly 98. An angle micro stop switch 126 is provided on conveyor bed 82 to activate cylinder 92 to advance piston 100 and lid attachment assembly 98. The four grooves 130 provided in conveyor bed 82 accommodate the four securing rods 132 which further assist in securing the lid 86 over the lip 104 of the containers 38.

Each of the securing rods 132 include a tapered end 136 to assist in the securement of the lid 86 over the lip 104 of the container 38. In operation, lid attachment assembly 98 advances the lid 86 through opening 84 in conveyor bed 82 onto the top of container 38 in flat registry with lip 104 prior to the pressing of deforming pad 96 on the center of the container to expel excess air and deform the center of the lid inwardly toward the filled container (FIG. 7) resulting in the expulsion of excess air or gas before the conforming lip on ring shaped frame 140 of lid attachment assembly 98 contacts and presses the periphery of lid 38 while the tapered ends 136 of the securing rods 132 engage the sides of the container to assist in forcing the sides of the lid 86 around the lip 104 of container 38 (FIG. 7) and assisting in the equalization of lateral forces to prevent tearing of the lid or tear tab 144. As ring shaped frame 140 of lid attachment assembly 98 contacts the upper surface of the lid 86 the sides of the lid 86 are forced around the container while lid leveling pad 96 maintains pressure upon the center of the lid. This maintenance of pressure on the center of the lid, as illustrated in FIG. 7, assists in securing the entire side 142 around the lip 104 of container 38. As will be recognized in many bulk filling operations, side 142 of lid 86 includes a perforated tear strip 144 (FIG. 7) which is part of side 142 of lid 86 and which is removed by the consumer of the bulk package before removing lid 86.

The novel bulk filling machine not only fills, seals and labels round containers, but also accommodates a variety of containers by providing laterally and elevationally adjustable guide rails 68 and 70 as well as providing for rectangular bulk containers. The conveyor bed 82 can be removed from lid attachment support bed 80 and a conveyor bed with a lid conforming rectangular opening can be substituted to convey rectangular shaped lids from the four lid guide rods 90 to a position below the lid attachment cylinder 92.

Figure 18:
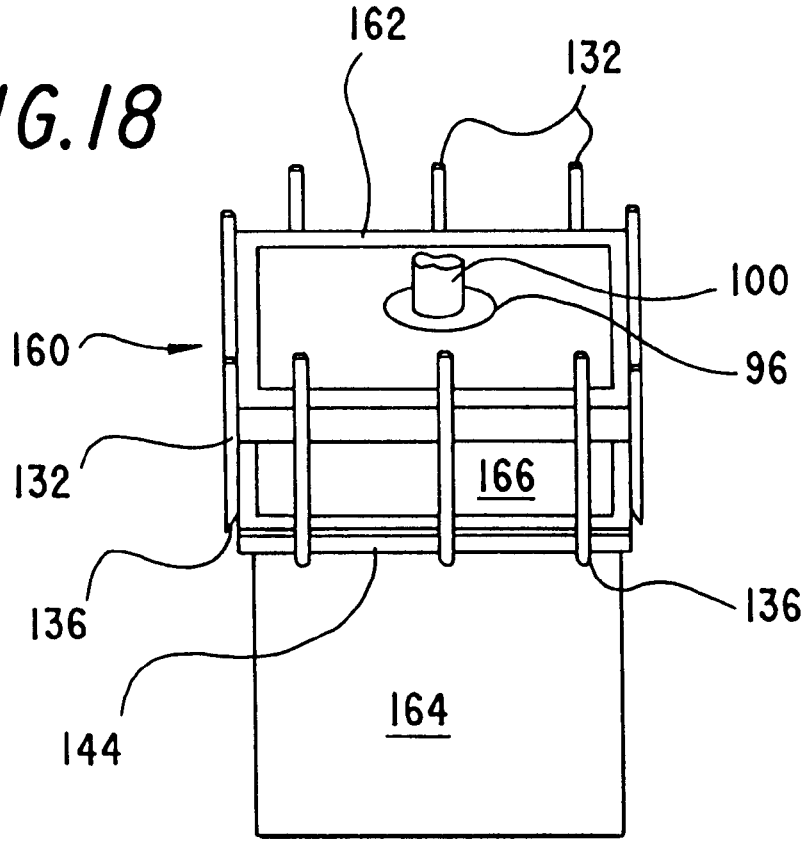
FIG. 18 is a perspective view of an alternative embodiment of a container centering and lid attachment assembly.
Figure 19:
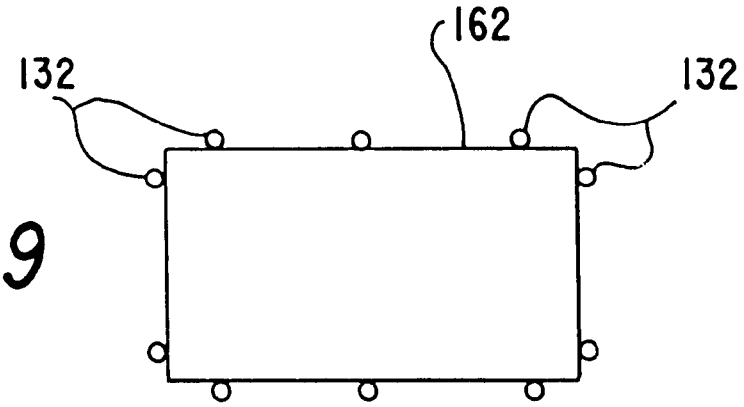
FIG. 19 is a top plan view of the container centering and lid attachment assembly of FIG. 18.
Figure 20:
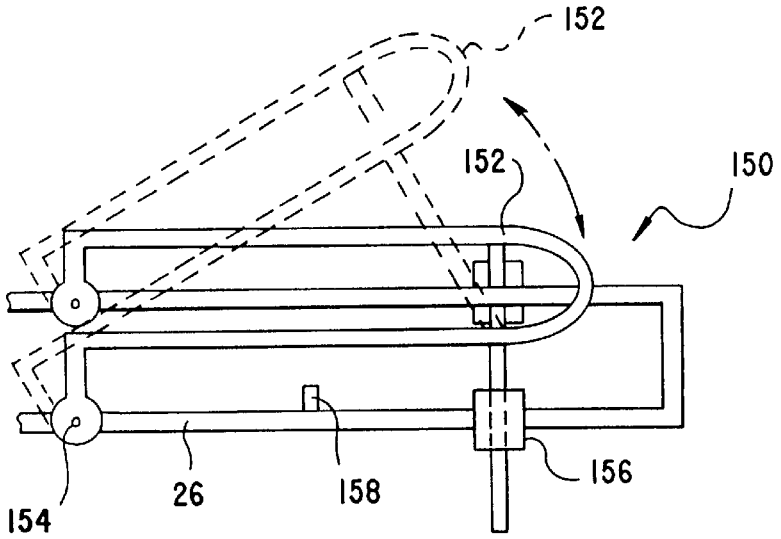
FIG. 20 is a perspective view of an accumulation device of the novel bulk filling machine.

As hereto fore described, the threadably attached container centering and lid attachment assembly 160 can be threadably attached to piston 100. Rectangular container centering and lid attachment assembly (FIGS. 18 and 19) includes a deforming pad 96 and centering and securing rods 132 with tapered ends 136 attached to a lid conforming rectangular frame 162. The centering operation of a rectangular container 164 on conveyor belt 30 is similar to that described with circular container 38 except the corner sides of container 164 may be utilized by rods 132 (FIG. 19) to position container 164 on conveyor belt 30.

In a similar manner as heretofore described, the conveyor bed with a rectangular opening deposits a rectangular lid 166 in flat registry with container 164 and lid attachment assembly 160 in a manner similar as heretofore described presses lid 166 over the lip of container 164 while maintaining the integrity of tear tab 144 by employing rods 132 and tapered ends 136 to dissipate forces around the periphery of cover 166. This is particularly important around the corners where a pair of rods 132 are provided not only for centering but also dissipating lateral forces that might otherwise destroy the integrity of tear tab 144 at the corners of rectangular lid 166.

Figure 26A:
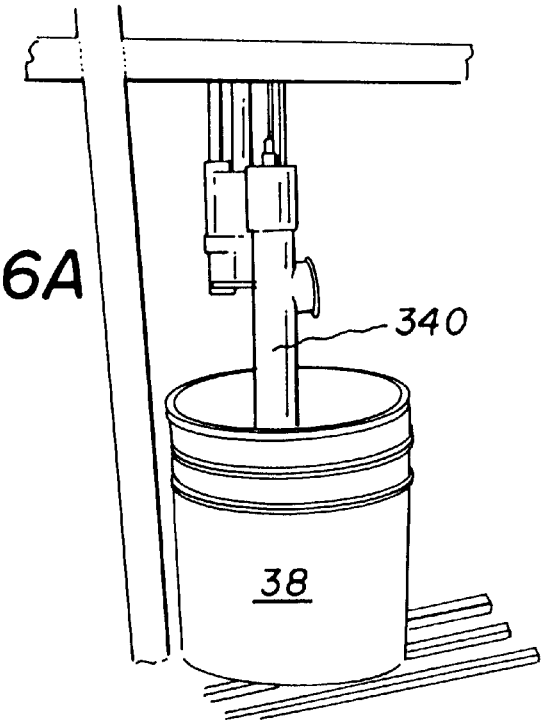
FIG. 26 is a side elevational view and FIG. 26A is a side elevational view of a retractable filler nozzle portion of the novel bulk filler machine of FIG. 23 which also illustrates a mechanism for adjusting for different size containers.
Figure 31:
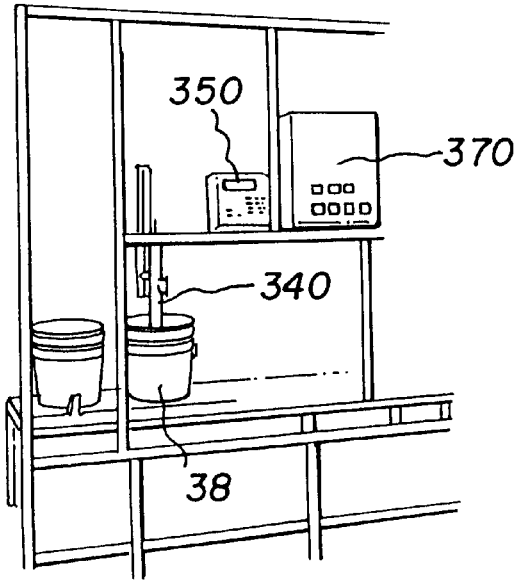
FIG. 31 is a perspective view of the control panel and housing for the circuitry for controlling the novel bulk filler machine of FIG. 23.
Figure 26:
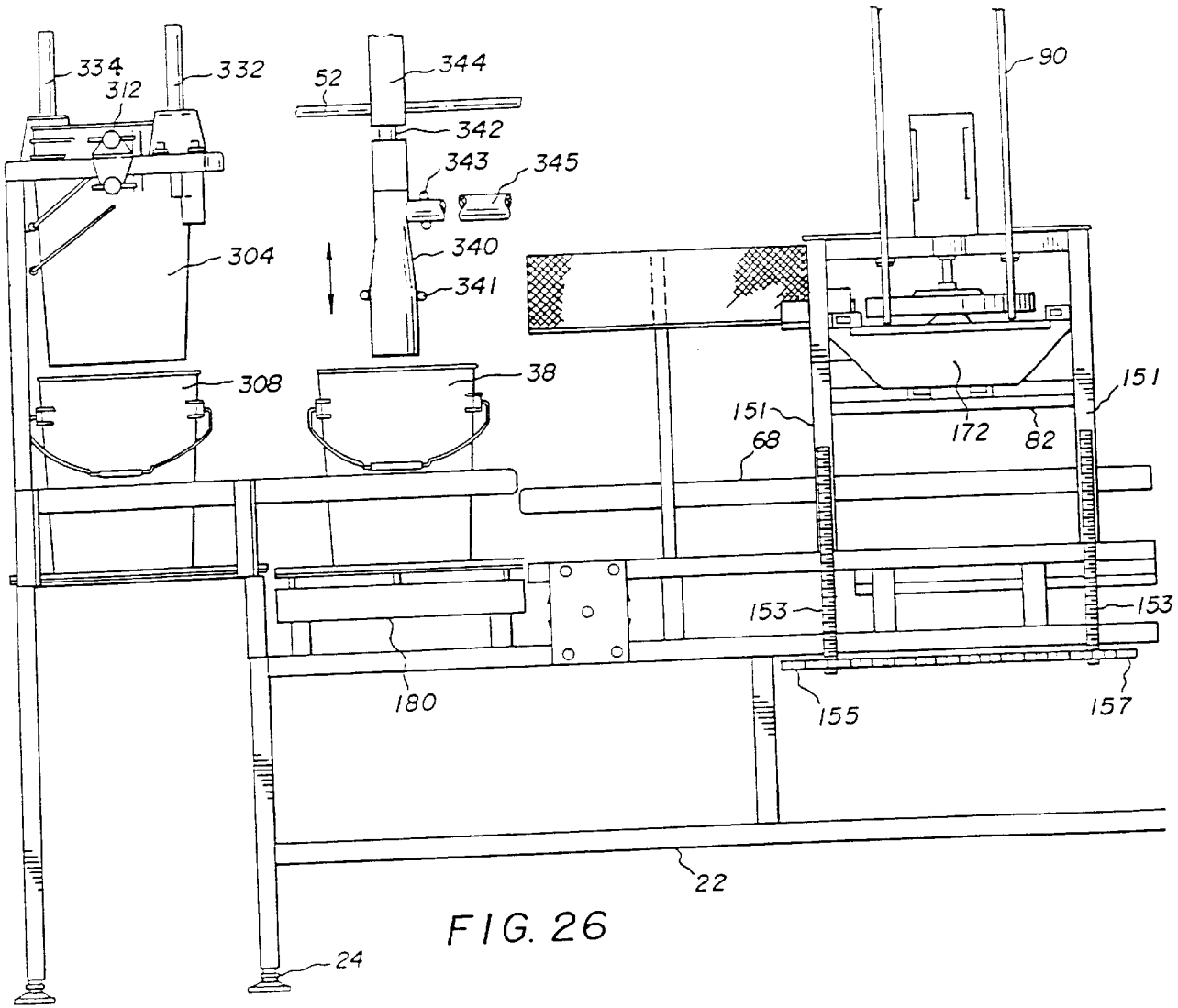

As has heretofore been described the conveyor bed can be easily removed and replaced to accommodate a wide variety of container lid sizes and shapes. A similar provision is made in the novel bulk filler machine of the best mode for accommodating a wide variety of bulk containers of different heights. Referring now to FIG. 26 frame 22 is modified by detaching the four supports 151 from conveyor frame 26. The four supports 151 are instead threadably supported by screw jack threads 153 which are preferably geared together through gears 155 and 157 to simultaneously raise and lower the entire lid attachment assembly uniformly to accommodate bulk containers of varying heights.

The conveyor bed 82 optionally includes a screen guard and the labeling station may also include an optional cover 170 (FIG, 2). A guard 172 (FIG. 4) is provided for the container centering and lid attachment assembly 98 as well as for a guard 174 (FIG. 2) for drive chain 48. Optional covers and guards may be also utilized where necessary to protect fill materials or moving parts.

Once the next consecutive container has been filled in input end 50 and the container in the lid attachment station 66 has been covered with a lid, the motor 46 advances conveyor belt 30 to receive a new unfilled container into input end 50 for filling while filled container is advanced to the lid attachment station 66 and the container covered with a lid is advanced toward the output end 106. In a preferred application of the invention, a labeling attachment station 110 (FIGS. 2 and 6) is provided intermediate the lid attachment station 66 and the output end 106. The optional labeling attachment station 110 preferably attaches labels to containers 38 simultaneous with the filling of a container 38 at the input end 50 and the application of a lid to a filled container 38 at the lid attachment station 66. The label 112 is attached to the side of container 38 (FIG. 7) by a labeling device 114, which may be a roller type labeling device, such as available from Labeltronix, Inc. Of Orange, Calif., or other such labeling assemblies as are available in the art.

Referring now to FIGS. 1–5 and 20, an optional accumulation mechanism 150 is illustrated. The accumulation mechanism 150 includes a U-shaped rail 152. U-shaped rail 152 is pivotally attached through pivot 154 to conveyor frame 26 and at the other end includes a pair of lifting cylinders 156 for lifting U-shaped rail 152 after a predetermined number of bulk fill containers have been accumulated at the output end 106 of the novel bulk filling machine 20. A counting mechanism 158 is provided to activate lifting cylinders 156 after a predetermined number of filled, sealed and labeled bulk containers are accumulated in U-shaped rail 152. As will be recognized by those skilled in the art, numerous other types of accumulation mechanisms can be provided for in combination with the novel automated bulk filling machine to accumulate filled, sealed and labeled containers for subsequent shipment on pallets.

Referring now to FIG. 7, an alternative embodiment of the invention is illustrated in which a gassing line 176 is provided for introducing a gas 178 into container 38. A separate retractable container positioning mechanism 180 may be provided in conveyor belt 30 to position container 38 on conveyor belt 30 before applying a lid 86 in flat registry with the container prior to the attachment of the lid 86 to the container 38.

Figure 21:
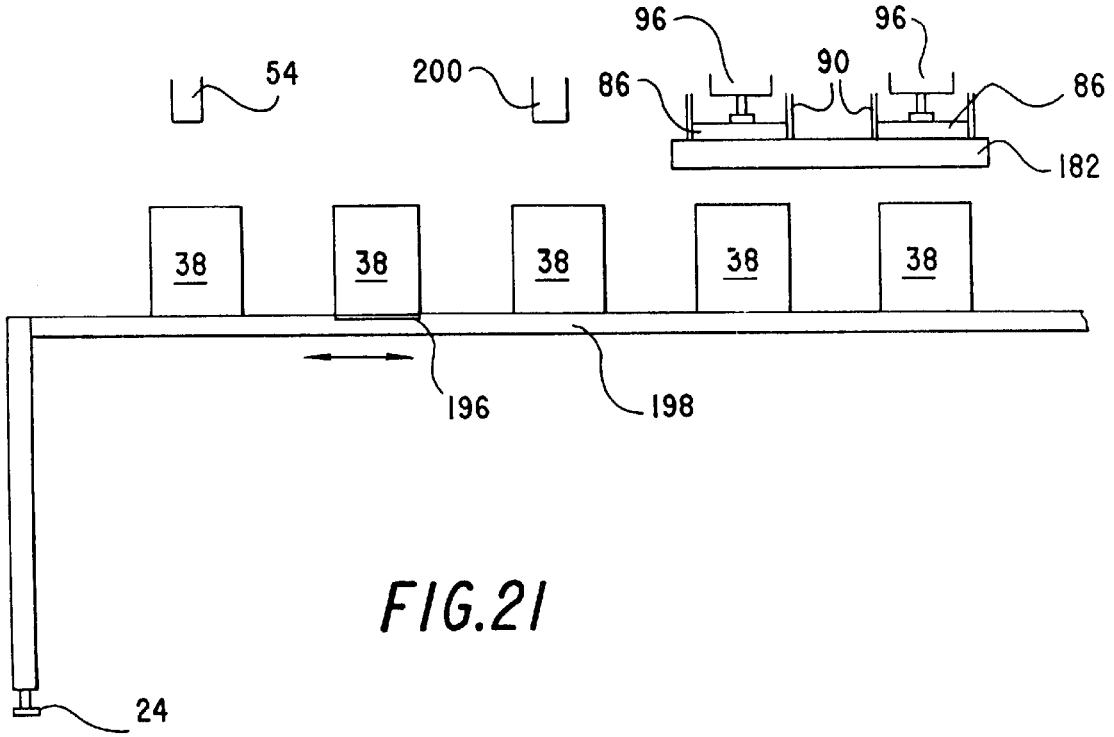
FIG. 21 is a fragmentary side elevational view of an alternative embodiment of the bulk filler machine illustrating a plurality of filling and processing stations prior to the application of the lid to the bulk container.

As illustrated in FIG. 21, conveyor bed 182 may be constructed in a number of ways to suit particular requirements and may utilize more than one opening for simultaneously placing and affixing two lids 86 on two tandem containers 38. The embodiment as illustrated in FIG. 21, utilizes two separate lid dispensing devices each having separate support rods 90 for holding two stacks of lids 86. Conveyor bed 182 simultaneously dispenses two lids at a time in a substantially flat configuration over the two containers 38. It is, of course, also possible to simultaneously affix the lids on groups of two or more lateral and/or tandem containers by utilizing the automated bulk filling machine utilizing a modified conveyor bed table 82 having two lateral and tandem openings with a widened conveyor bed 82 having a second group of guide rods 90 and a second lid attachment cylinder 92 in a tandem relationship.

FIG. 21 also illustrates a further embodiment of the invention in which a container 38 is filled through a fill nozzle 54 to a particular weight of particulate material. Thereafter container 38 is moved to a separate processing station 196 where the contents of container 38 are agitated, heated or further processed before the container is moved to a second filling station 198 where additional ingredients or materials are added through a second nozzle 200 to produce a final multi component bulk product which is subsequently sealed in the novel automated bulk filling machine utilizing a conveyor bed 82 having two lid openings and two separate lid attachment cylinders 92 for simultaneously attaching two lids to a pair of tandem containers in the novel automated bulk filling machine.

Figure 6:
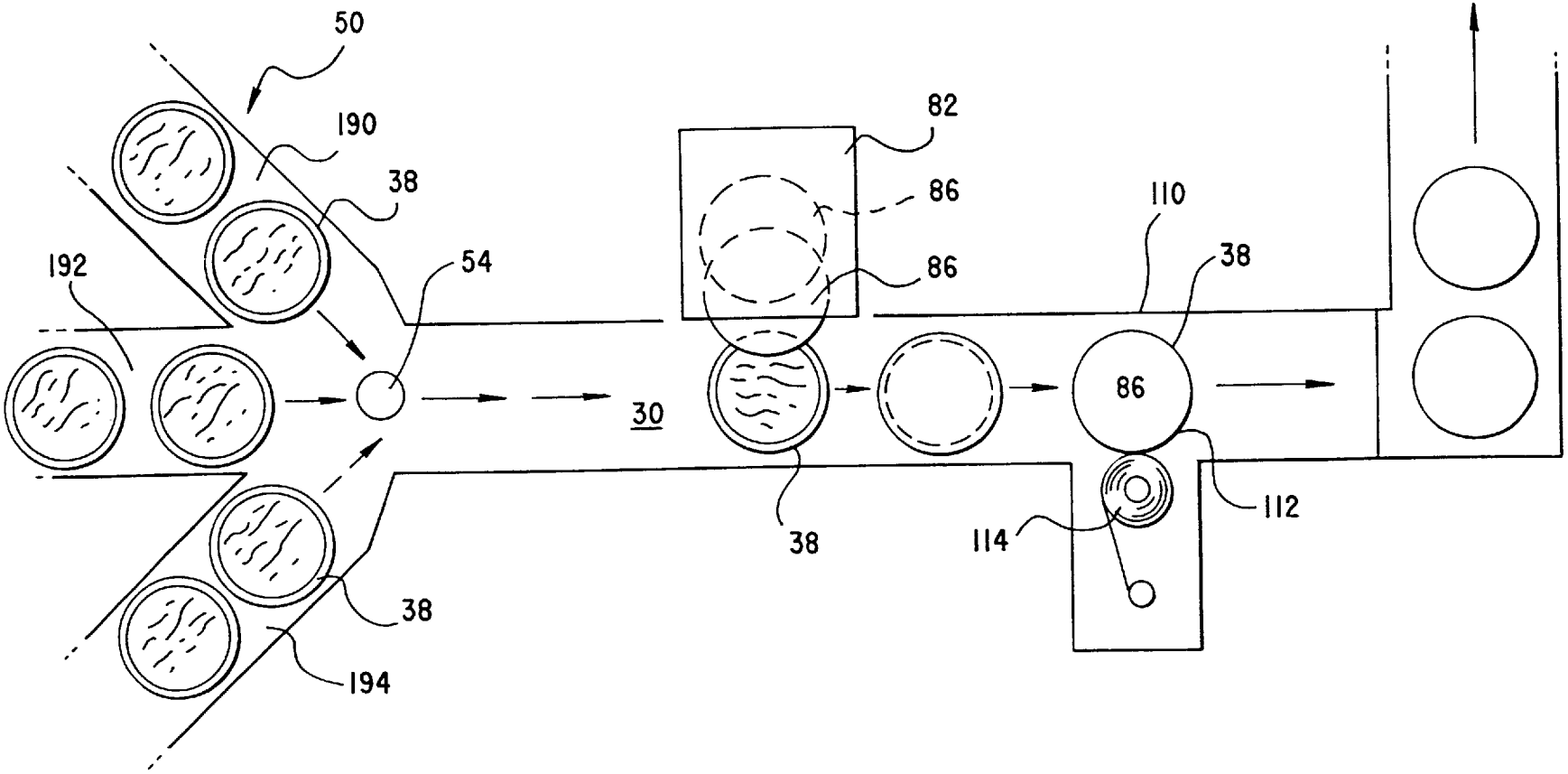
FIG. 6 is a schematic top plan view of the novel bulk filler machine illustrating an alternative embodiment for the input of containers to the novel bulk filler machine.

Referring now to FIG. 6, a further embodiment of the invention is illustrated in which input end 50 includes three separate in-feed conveyors 190, 192 and 194 for advancing containers to the product fill nozzle 54. In such applications where increased rates of production are desired, input end 50 may include a plurality of product dispensing nozzles 54 to increase the speed of filling bulk containers.

Figure 22:
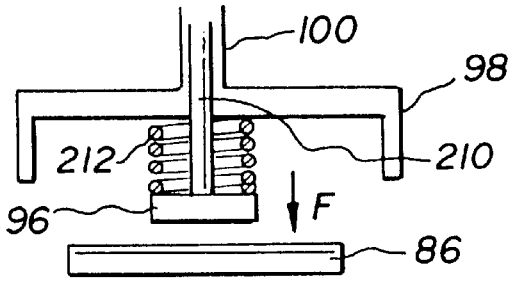
FIG. 22 is a side elevational view of a further embodiment of the container and lid attachment assembly.

Referring now to FIG. 22, the piston 100 may be mounted to container centering and lid attachment assembly 98 with deforming pad 96 separately mounted to a piston 210 with a spring 212. The piston 210 and spring 212 can provide a separate floating and tension force F on the lid to assist in the attachment of lid 86 to container 38 in certain applications.

The invention may be used for circular, rectangular or lids of any configuration utilizing the machine and method of the present invention. The utilization of lids other than circular requires the substitution of a modified conveyor bed for the conveyor bed 82 and the substitution of a modified lid attachment assembly 98 as heretofore described to provide a matching geometric configuration of the lid so that the outer periphery of the lid attachment assembly 98 matches the configuration of the lid so that advancement of the lid attachment assembly results in contacting the periphery of the lid. Similarly the arrangement of the centering and securing rods 132 must be configured according to the shape of the container and lid to provide combined centering and securing capabilities. Where combined centering and securing capabilities are not possible due to the shape of the container or lid, a separate container centering or positioning mechanism 180 can be provided to deploy through openings in the conveyor bed to center the container as illustrated in FIG. 7.

In the process of applying the lid, the combination of the deforming pad 96 for deforming the center of the lid in combination with the lid attachment assembly 98 provides first for the deformation of the lid at or near the center of the lid before the container lid conforming frame assembly contacts the perimeter of the lid forcing the entire side 142 over the lip 104 of the container 38. The tapering ends 136 assist in limiting the lateral deformation of the lid and assist in providing uniformity in the expansion of the lid laterally around the lip 104 of container 38 to prevent tearing of the lid or the tear tab 144 to allow the tear tab to remain intact until removed by the consumer.

Figure 23:
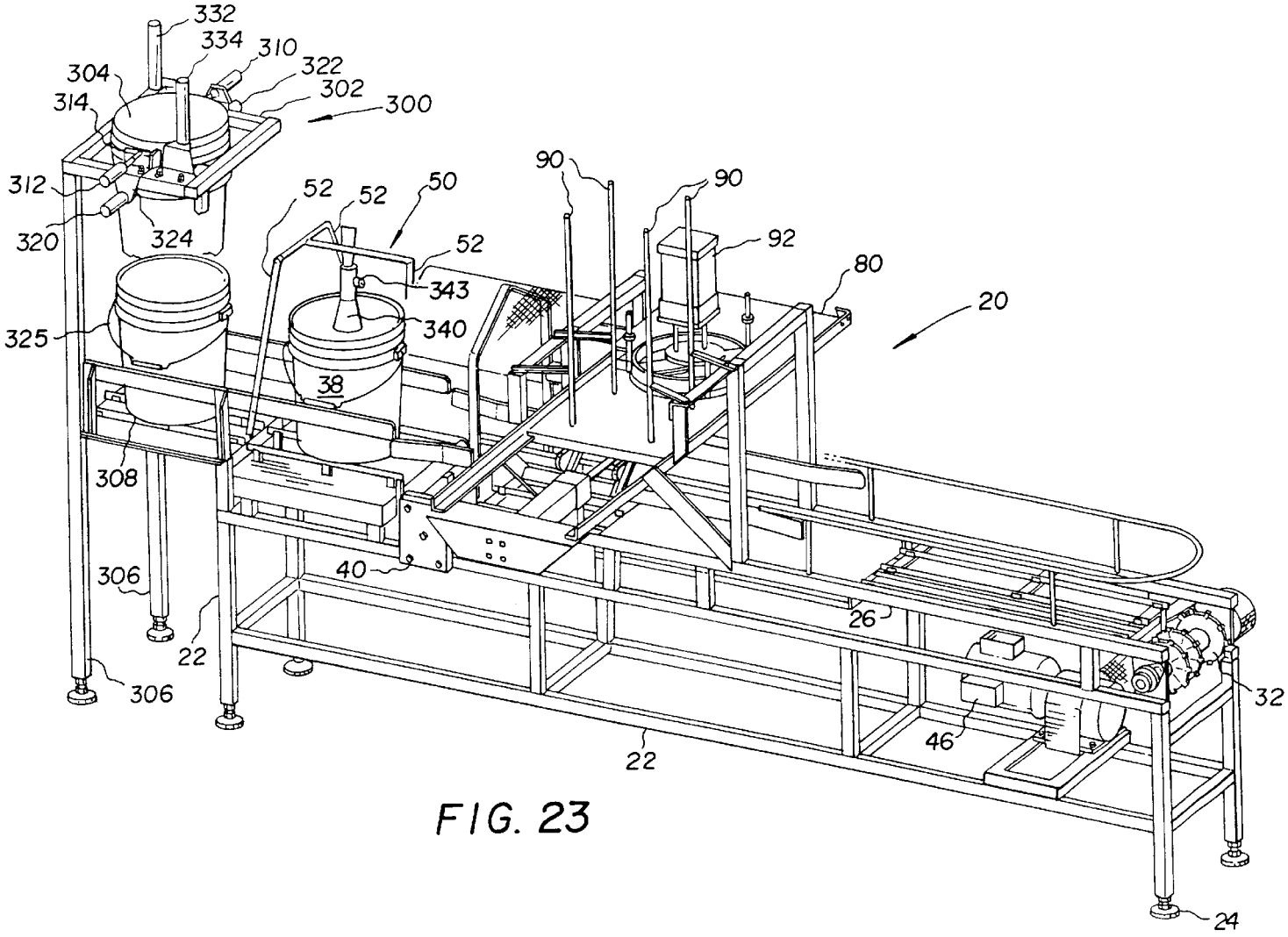
FIG. 23 is an isometric view of a novel bulk filler machine with portions of the frame and the conveyor belt removed similar to FIG. 1, illustrating the best mode of the invention.
Figure 24:
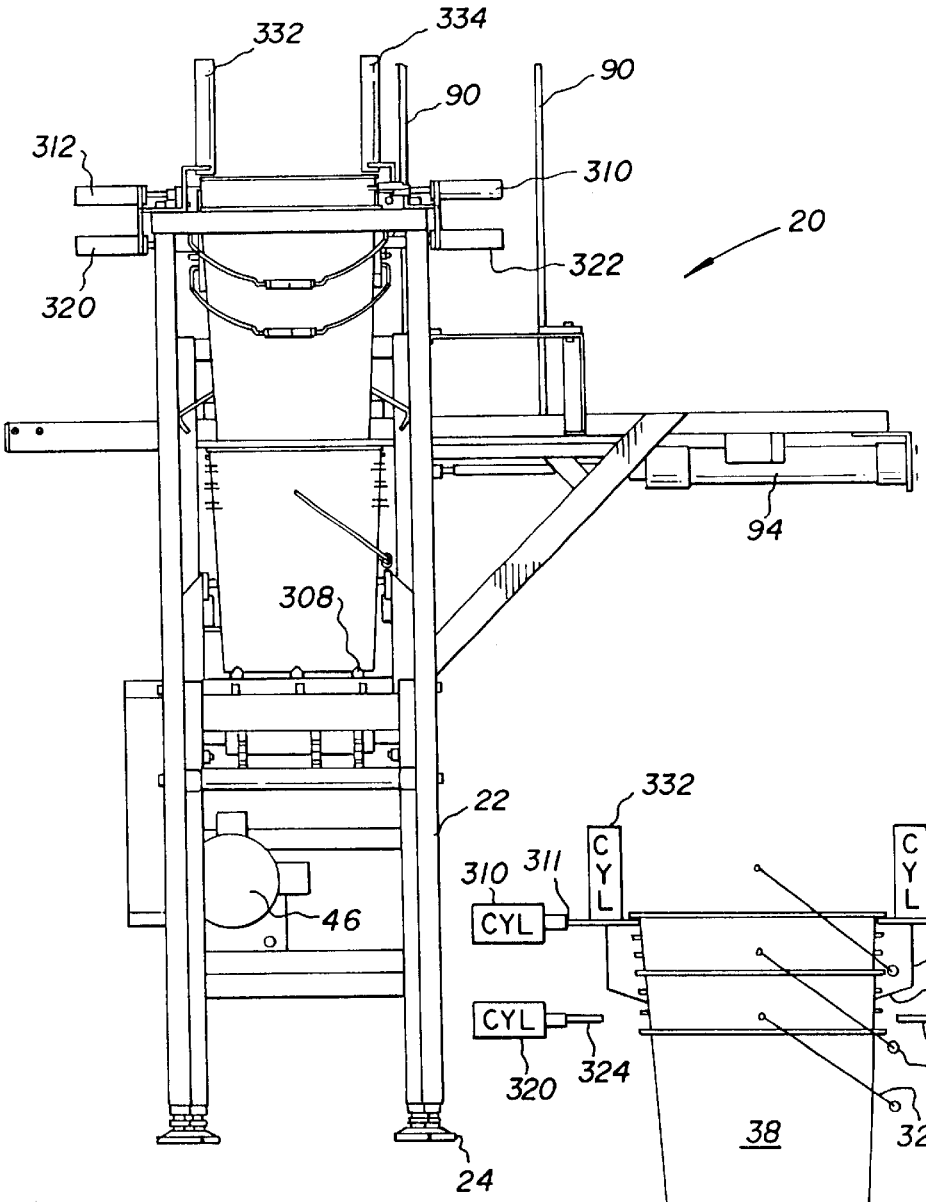
FIG. 24 is a front elevational view of the novel bulk filler machine of FIG. 23.
Figure 25A:
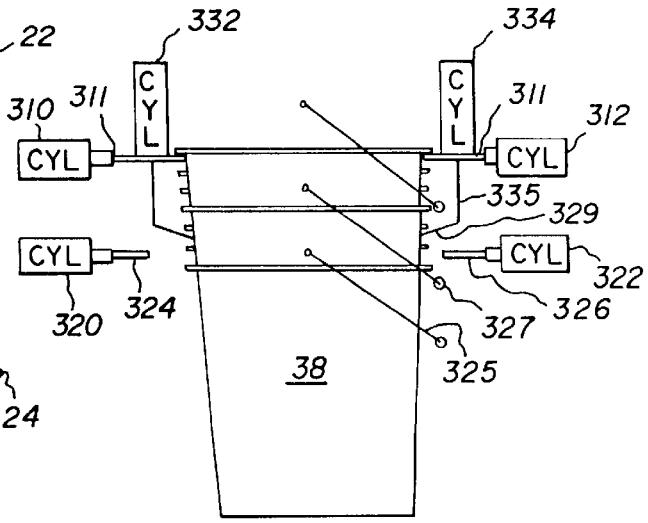
FIG. 25A is a side elevational view illustrating a further embodiment of the denesting or container separation mechanism for accommodating handles of bulk containers similar to FIG. 23.
Figure 25:
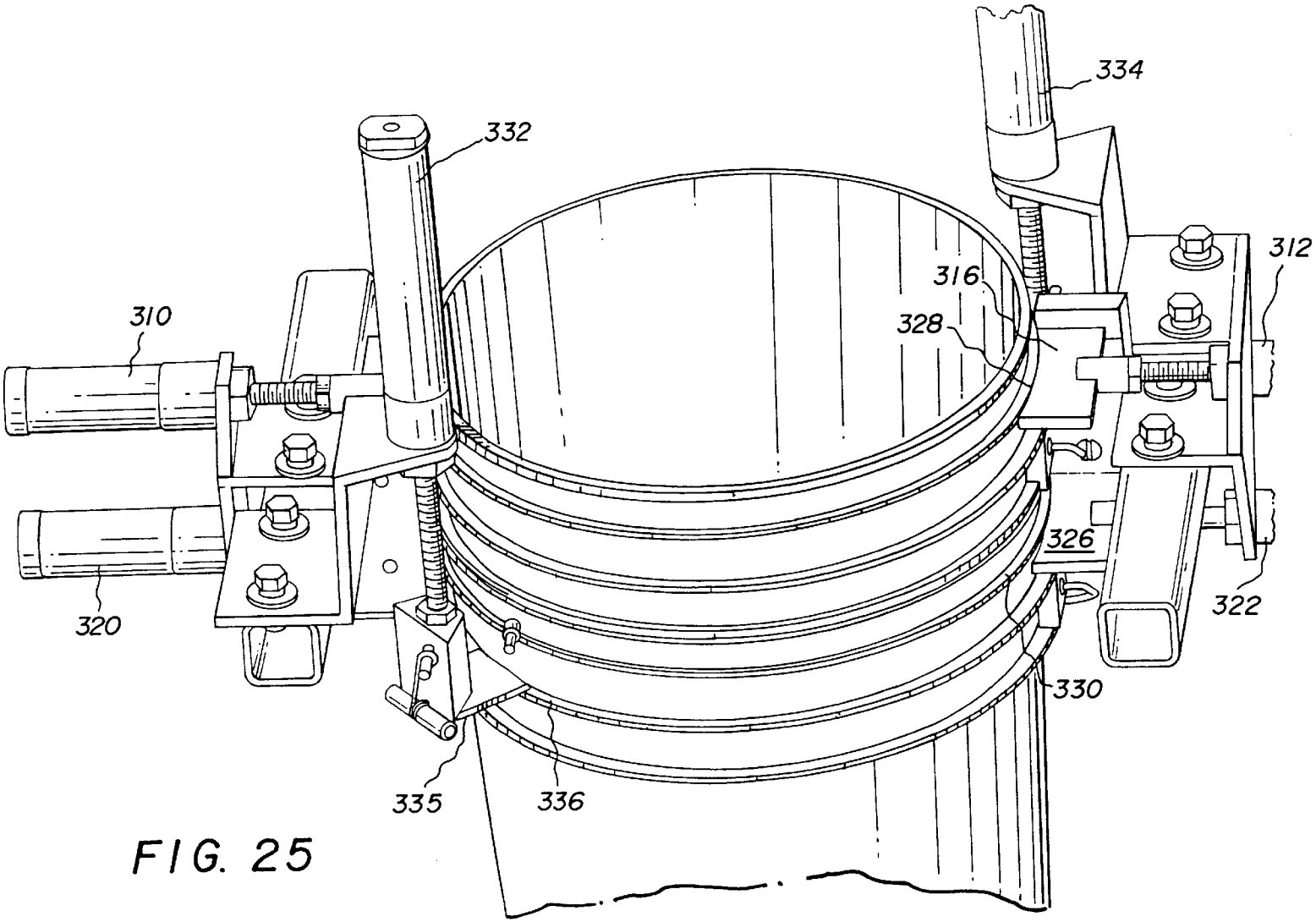
FIG. 25 is a perspective view of the bulk container separation and advancement device of the novel bulk filler machine of FIG. 23.

Referring now to FIGS. 23, 24 and 25, an automated bulk filler machine is illustrated as constructed in accordance with the best mode of the invention. The novel automated bulk filler machine includes a bulk container separation and advancement device 300 at the input end 50. The bulk container separation and advancement device 300 includes a frame 302 for carrying a stack of bulk containers 304. The frame 302 is supported by a pair of adjustable support legs 306 which carry a conveyor platform 308 which may be designed to engage frame 22 of the novel bulk filler machine 20.

Conveyor platform 308 may be driven by motor 46 or include a separate motor for indexing and advancing bulk containers 38 to input end 50. Bulk container separation and advancement device 300 includes a first pair of laterally adjacent piston and cylinders 310, 312 for activating lip latching mechanisms 314 (FIG. 23) and 316 (FIG. 25) for periodically bearing a stack of bulk containers 304. A second pair of laterally adjacent piston and cylinders 320 and 322 are disposed vertically adjacent to the first pair of laterally adjacent piston and cylinders 310 and 312. The second pair of pistons and cylinders 320 and 322 similarly activate a pair of lip latching mechanisms 324 (FIG. 23) and 326 (FIG. 25).

The pneumatic activation of the first pair of laterally adjacent piston and cylinders 310 and 312 are designed to support bulk container stack 304 by engaging bulk container lip 328 while the second pair of laterally adjacent pistons 320 and 322 remove lip latching mechanisms 324 and 326 from lip 330 from the bulk container at the bottom of the stack 304. Depending on the type of container the retraction of the lip latching mechanisms 324 and 326 is sometimes insufficient to allow gravity to pull the bulk container from the bottom of the stack or when handle 325 contacts the side of the container preventing the free fall of the container. As a result a second pair of piston and cylinders 332 and 334 are provided to advance diametrically opposed spring biased plates or latching mechanisms 335 to push the bottom bulk container from the stack of bulk containers and deposit the bulk container on platform 308.

In some cases it is preferable to modify the denesting or bulk container separation device to specifically accommodate the handle of the bulk container as illustrated in FIG. 25A. In FIG. 25A pistons and cylinders 310 and 312 include a bracket 311 for carrying pistons and cylinders 332 and 334. Pistons and cylinders 320 and 322 are connected to latching mechanisms 335 and are mechanically and operationally the same as has heretofore been described with respect to FIGS. 23–25.

As is known by those skilled in the art bulk container handles 325 in nested containers are all oriented in the same direction. The retraction of the pistons by cylinders 310 and 312 which carry pistons and cylinders 332 and 334 on brackets 311 cause the lateral travel of latching mechanism 335 to allow the handle of the bucket to pass freely from a position within latching mechanism 335 to a position below latching mechanism 335. Once the handle has moved to a position below latching mechanism 335 as illustrated in FIG. 25A the latching mechanism 324 and 326 are retracted by pistons and cylinders 320 and 322. The removal of the latching mechanisms 324 and 326 result in the activation piston and cylinders 332 and 334 to remove the bottom bulk container 38 from the nested stack while the cylindrical handle grip 327 of the next bulk container rolls over the inclined plane 329 of the latching mechanism 335.

The platform 308 may include a chain with rods or plates (not shown) to positively engage the sides of the bulk container to advance the bulk container along the length of platform 308 to input end 50 of the novel bulk filler machine. The indexing chain or other means for advancing containers assists in the control of the bulk container on platform 308.

The bulk container 38 on platform 308 is advanced to the fill station at input end 50 as has heretofore been described. In the best mode of the invention the fill nozzle can be moveably disposed on support tubes 52 so that it may be raised and lowered during filling operations. The fill nozzle in accordance with the best mode may also be of a tapered elongated nozzle 340 and is lowered into container 38 (FIGS. 26 and 26A) by a piston 342 activated by a cylinder 344. The lowering of the tapered elongated nozzle 340 into bulk container 38 increases the efficiency of the bulk filling operation as has heretofore been discussed. The tapered elongated nozzle 340 is retracted as the bulk container is filled by activating cylinder 344 to gradually retract piston 342 consistent with the filling characteristics of the bulk material dispensed into bulk container 38. The tapered elongated nozzle in the best mode of the invention is made of stainless steel or other material that includes flanges 341 for changing nozzles and for ease of cleaning as well as flange 343 for connecting a bulk product supply hose 345.

Referring now to FIGS. 27–31 the electronic circuitry for controlling the operation of the novel automated bulk filling machine is illustrated. The electronic circuitry is controlled by a microprocessor 350 which contains a keypad and display for receiving instructions for filling the bulk containers. A display is provided to display the weight of each filled container and to indicate any requirements of the system such as the need for more bulk containers, lids or other supply materials. The panel (FIG. 29) includes a power button 352, a clean in place (CIP) control button 354, an index button 356, a denester button 358 for operating the bulk container separation device, an index conveyor button 360 for operating the conveyor on platform 308, a scale button 362 to zero and operate the scale and a conveyor button 364 for operating the conveyor belt 30.

Figure 27A:
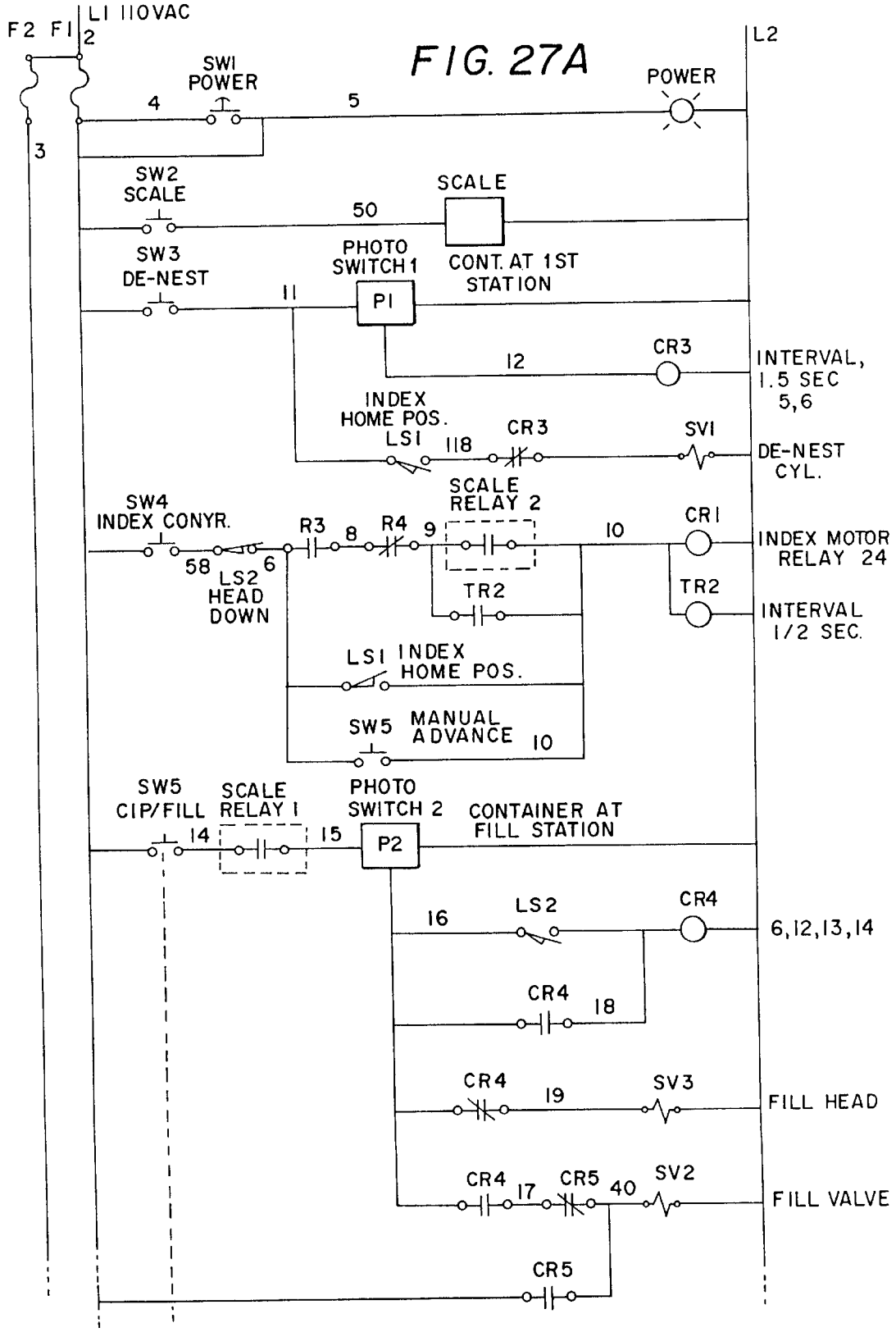
FIG. 27 is a circuit diagram for operating the novel automated bulk filler machine of FIG. 23.
Figure 27B:
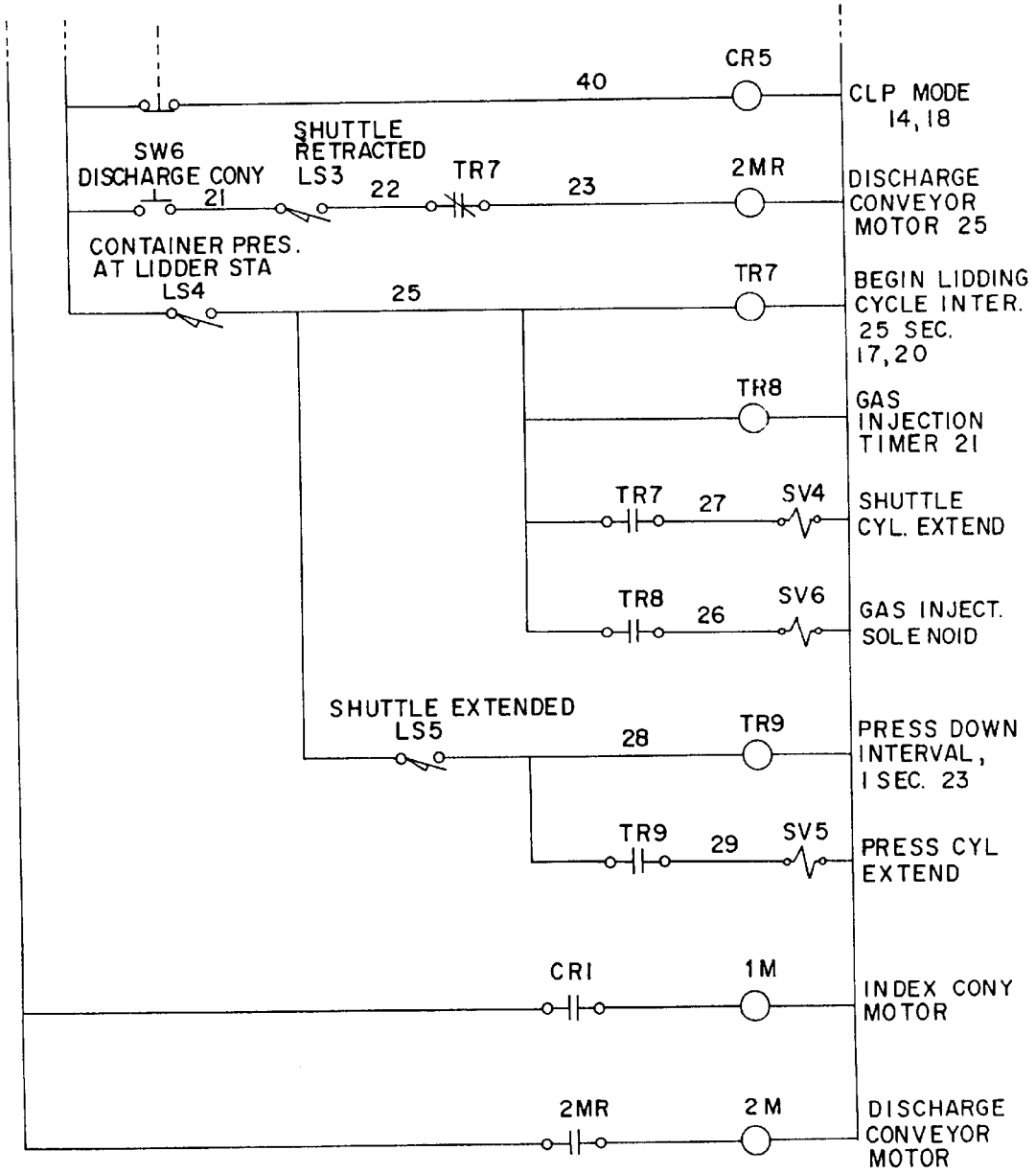
Figure 28:
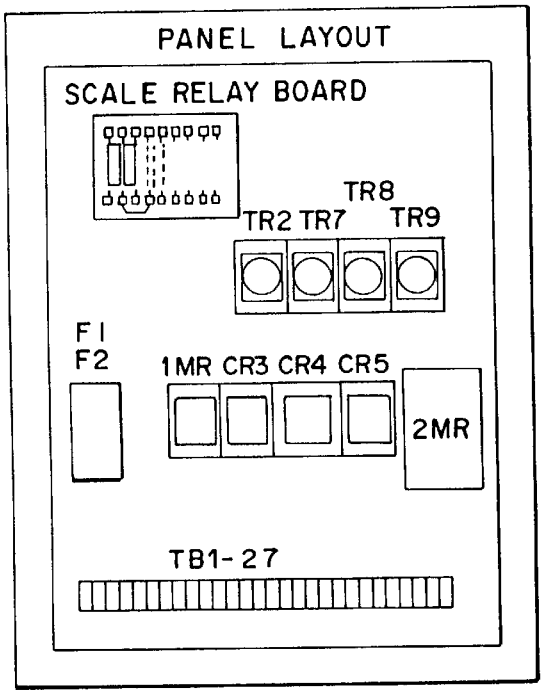
FIGS. 28 and 29 are frontal views of a panel layout and legend plate diagram for the novel automated bulk filler machine of FIG. 23.
Figure 29:
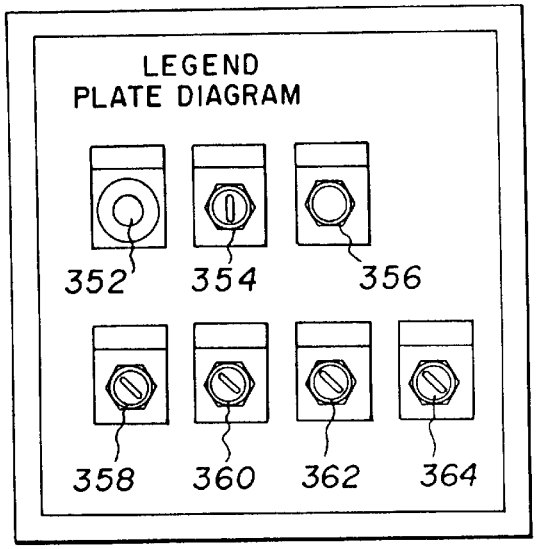
Figure 30:
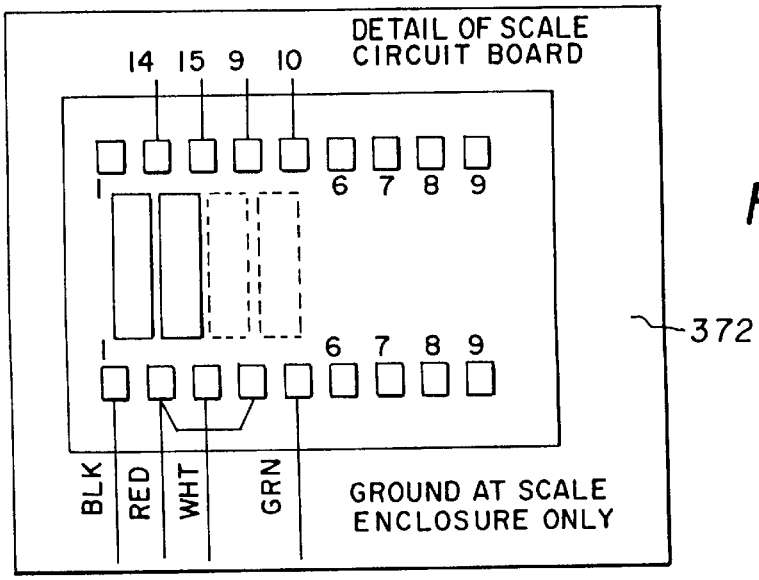
FIG. 30 is a diagrammatic view of a relay circuit board for a novel automated bulk filler machine of FIG. 23.

Housing 370 (FIG. 31) contains the panel (FIG. 2) as well as the circuitry for operating the novel automated bulk filling machine. The circuitry includes a panel layout (FIG. 28) with a scale relay board 372 which is illustrated in greater detail in FIG. 30. The circuitry for operating each of the motors, cylinders, fill valves, CIP components, gas injection and discharge conveyor device is illustrated in FIG. 27. The source of air cylinders, switches, motors and other available components are listed in the Bill of Materials included with FIG. 27.

The method of the invention contemplates the utilization of a centering mechanism for centering the container on the conveyor before the application of a lid in substantial planar registry with the lip of the container prior to the activation of a deforming pad for pressing the center of the lid down toward the center of a filled container thereby providing for expelling excess air in container 38 while deforming the edges of the lid before the periphery of the lid is pushed over the lip of the filled container. In accordance with the method of the invention, means is provided for uniformly accommodating the lateral expansion of the sides of the lid to prevent tearing, ripping or other destruction of the seal or the lid with the tear tab which is applied at the same time that the lid is applied to the filled container.

The best mode of method of the invention also includes the optional steps of separating a bulk container from the bottom of a stack of empty bulk containers and advancing the empty bulk container to the filling and covering steps. The invention also includes the optional steps of labeling and accumulating a group of bulk containers for subsequent packaging on pallets or other shipment containers.

As will be recognized by those skilled in the art, the invention has a wide range of applicability and can be modified in numerous ways to suit particular requirements. For example, while the invention has been described with respect to bulk containers having circular and rectangular lids, the invention is equally applicable to filling bulk containers having other shapes with lids of other shapes in accordance with the principles of the present invention. It will also be recognized that the invention may also be utilized to provide for the filling and sealing of multiple bulk containers on the novel automated bulk filling machine and that additional conveyors and stations in addition to the bulk container separation, advancement, accumulation and labeling station may be provided throughout the length of the novel automated bulk filling machine in accordance with the principles of the invention.

The automated bulk filling machine may also be configured in a variety of ways to suit particular requirements utilizing a conveyor with filling and sealing stations automatically controlled to fill and seal bulk containers by applying a lid in a substantially flat planar configuration over the filled container and pressing the center of the lid to expel excess gasses within the container before pressing the sides of the lid over the lip of the bulk container. These and other modifications may be made by those skilled in the art in applying the invention to suit particular requirements.

As used herein and in the following claims, the word "comprising" or "comprises" is used in its American technical sense to mean the enumerated elements include but do not exclude additional elements which may or may not be specifically included in the dependent claims. It will be understood that such additional, whether or not included in the dependent claims, are modifications that can be made within the scope of the invention. It will also be appreciated that these and other modifications can be made within the scope of the invention as defined in the following claims.

What is claimed is:

1. A container filling machine comprising:

(a) a conveyor having an input end and an output end;

(b) a positioning mechanism for positioning a container on said conveyor;

(c) a lid dispensing mechanism for depositing a container lid in substantially flat registry on the rim of a container, said lid dispensing mechanism disposed intermediate the ends of said conveyor;

(d) a deforming pad disposed in substantial vertical alignment with the center of said container lid for first pressing the center of said container lid down on said container;

(e) a lid attachment mechanism disposed in axial alignment with said deforming pad for pressing the perimeter of said container lid on the lip of said container;

(f) a plurality of centering and securing rods disposed on said lid attachment mechanism; and (g) motor means for periodically advancing said conveyor.

2. The container filling machine of claim 1 further comprising means for adjusting the distance between said lid dispensing mechanism and said conveyor.

3. The container filling machine of claim 1 further comprising an additional work station disposed along the length of said conveyor.

4. The container filling machine of claim 3 wherein said additional work station includes a fill station disposed at the input end of said conveyor.

5. The container filling machine of claim 4 wherein said fill station includes means for lowering a fill nozzle into the container and gradually raising said fill nozzle during filling.

6. The container filling machine of claim 3 wherein said additional work station includes a labeling station.

7. The container filling machine of claim 3 wherein said additional work station includes a bulk container separation device.

8. The container filling machine of claim 3 wherein said additional work station includes a bulk container advancement device.

9. The container filling machine of claim 3 wherein said additional work station includes an accumulation station.

10. The container filling machine of claim 1 wherein said lid dispensing mechanism includes a slidable flat bed with an opening for transferring a lid from a lid storage device to a position in substantially flat registry with said rim.

11. The container filling machine of claim 10 wherein said slidable flat bed includes a plurality of openings.

12. The container filling machine of claim 10 wherein said slidable flat bed is pneumatically activated.

13. The container filling machine of claim 1 wherein said deforming pad is mounted on said lid attachment mechanism.

14. The container filling machine of claim 13 wherein said plurality of centering and securing rods are disposed on the perimeter of said lid attachment mechanism.

15. The container filling machine of claim 1 wherein said lid attachment mechanism is pneumatically activated.

16. The container filling machine of claim 15 wherein said lid attachment mechanism is threadably attached to a pneumatically activated piston.

17. The container filling machine of claim 1 wherein said lid attachment mechanism includes a plurality of tapered rods disposed along the perimeter of said lid attachment mechanism.

18. A container closure machine comprising:

(a) a lid dispensing mechanism for depositing a container lid in substantially flat registry with the rim of a container, said lid dispensing mechanism having an opening therein for receiving a container lid;

(b) a deforming pad disposed in substantial horizontal alignment with said lid dispensing mechanism;

(c) a lid attachment mechanism disposed in axial alignment with said deforming pad for pressing the perimeter of said container lid on the lip of said container; and (d) a plurality of tapered rods disposed around the perimeter of said lid attachment mechanism.

19. The container closure machine of claim 18 further comprising a bulk container separation and advancement apparatus.

20. The container closure machine of claim 18 wherein said lid dispensing mechanism, said deforming pad and said lid attachment mechanism are pneumatically controlled.

21. The container closure machine of claim 20 wherein said lid attachment mechanism is of a generally circular configuration.

22. The container closure machine of claim 21 wherein said lid attachment mechanism is of a generally rectangular configuration.

23. A bulk container filler machine comprising:

(a) a conveyor having an input end and an output end;

(b) a filling mechanism disposed at the input end of said conveyor;

(c) a slidably disposed lid transfer mechanism for depositing a container lid in substantially flat registry on the rim of a container;

(d) a leveling pad in substantial vertical alignment with the center of a container lid for deforming said container lid;

(e) a lid attachment mechanism circumscribing said leveling pad for pressing the perimeter of said container lid over the lip of said container in cooperation with said leveling pad;

(f) a bulk container separation apparatus having a plurality of lip latching mechanisms divided into a first set of pneumatically activated cylinders with lip latching mechanisms and a second set of pneumatically activated cylinders with lip latching mechanisms said first set and said second set disposed horizontally to each other and a third set of pneumatically activated cylinders with lip latching mechanisms disposed vertically with respect to said first set and said second set; and (g) motor means for periodically advancing said container.

24. The bulk container filling machine of claim 23 further comprising a labeling station disposed intermediate said input end and said output end of said conveyor.

25. The bulk container filling machine of claim 24 further comprising an accumulation station disposed at the output end of said conveyor.

26. The bulk container filling machine of claim 23 wherein said bulk container separation apparatus is disposed at said input end.

27. The bulk container filling machine of claim 23 wherein said pneumatically activated cylinders include pistons attached to said lip latching mechanisms.

28. The bulk container filling machine of claim 23 wherein said third set of pneumatically activated cylinders with lip latching mechanisms are carried on a bracket activated by said first set of pneumatically activated cylinders.

29. The bulk container filling machine of claim 28 wherein said lip latching mechanisms of said third set of pneumatically activated cylinders are tapered to accommodate the cylindrical handle of a bulk container.

30. The bulk container filling machine of claim 23 wherein said filling mechanism is disposed on a pair of pistons for raising and lowering said filling mechanism.

31. The bulk container filling machine of claim 30 wherein said filling mechanism is an elongated nozzle.

32. The bulk container filling machine of claim 31 wherein said elongated nozzle is tapered.

33. A bulk container separation device comprising:

(a) a frame having vertical and horizontal supports;

(b) a conveyor means disposed on said horizontal support;

(c) a bulk container support disposed on said horizontal support said bulk container support having a first pair of lip latching mechanisms disposed substantially laterally adjacent to each other, said lip latching mechanisms activated by cylinders to alternatively move horizontally toward and away from each other; and (d) a second pair of lip latching mechanisms disposed substantially laterally adjacent to each other on said horizontal support and activated by cylinders to move said second pair of lip latching mechanisms vertically toward and away from said first pair of lip latching mechanisms.

34. The bulk container separation device of claim 33 wherein said first pair of lip latching mechanisms and said second pair of lip latching mechanisms are pneumatically activated.

35. The bulk container separation device of claim 34 wherein said first pair of lip latching mechanisms are activated by pneumatically activated cylinders disposed vertically adjacent to a second set of pneumatically activated cylinders.

36. The bulk container separation device of claim 33 further comprising a third pair of lip latching mechanisms disposed in axial alignment with said first pair of lip latching mechanisms.

37. A method of filling and sealing containers comprising the steps of:

(a) providing a plurality of stations along the length of a conveyor and means for synchronously starting and stopping said conveyor at each of said plurality of stations;

(b) filling at least one container at a filling station;

(c) depositing a lid of a container in flat registry with the rim of a filled container;

(d) pressing the center of the lid of the container to deform the center of the lid downwardly toward the center of said filled container; and (e) pushing uniformly on the perimeter of the lid down over the rim of a filled container while limiting the radial expansion of said perimeter of said lid.

38. The method of filling and sealing containers of claim 37 wherein said step of pushing and limiting said radial expansion is achieved with a plurality of tapered rods.

39. The method of filling and sealing containers of claim 38 further comprising the step of gassing the contents of the container prior to said step of depositing the lid on said container.

40. The method of filling and sealing containers of claim 37 wherein said step of depositing includes simultaneously depositing a plurality of lids on a plurality of filled containers.

41. The method of filling and sealing containers of claim 40 wherein said step of pressing includes simultaneously pressing a plurality of lids.

42. The method of filling and sealing containers of claim 40 further comprising the step of gassing said plurality of containers before said step of depositing said plurality of lids.

43. The method of filling and sealing containers of claim 37 further comprising the step of labeling filled and sealed containers.

44. The method of filling and sealing containers of claim 43 wherein said step of filling is achieved by raising a filling nozzle while filling.

45. The method of filling and sealing containers of claim 44 further comprising the step of separating a container from a plurality of stacked containers prior to said step of filling.

46. The method of filling and sealing containers of claim 37 further comprising the step of separating a container from a plurality of stacked containers.

* * * * *